US006808374B2

(12) United States Patent
Phallen et al.

(10) Patent No.: US 6,808,374 B2
(45) Date of Patent: Oct. 26, 2004

(54) SANITARY DESIGN GEAR PUMP

(75) Inventors: Iver J. Phallen, Youngstown, NY (US); Richard J. Jezuit, Jr., Lancaster, NY (US); David C. Messing, North Tonawanda, NY (US); Gregory N. Tufte, Maple Grove, MN (US); Frank L. Amyotte, St. Paul, MN (US); Bruce A. Maki, Hugo, MN (US)

(73) Assignees: Niagara Pump Corporation, Tonawanda, NY (US); Hypso Corporation, New Brishton, MN (US)

( * ) Notice: Subject to any disclaimer, the term of this patent is extended or adjusted under 35 U.S.C. 154(b) by 0 days.

(21) Appl. No.: 10/040,271

(22) Filed: Oct. 19, 2001

(65) Prior Publication Data

US 2002/0159906 A1 Oct. 31, 2002

Related U.S. Application Data

(60) Provisional application No. 60/241,874, filed on Oct. 20, 2000.

(51) Int. Cl.[7] ..... F03C 2/00

(52) U.S. Cl. ..... 418/132; 418/144; 418/257; 418/70

(58) Field of Search ..... 418/132, 144, 418/70, 257

(56) References Cited

U.S. PATENT DOCUMENTS 2,462,214 A * 2/1949 Namur ..... 418/257
2,635,552 A 4/1953 Dale et al.
2,909,124 A 10/1959 Maisch
3,137,238 A * 6/1964 Gordon ..... 418/74
3,150,593 A * 9/1964 Funk et al. ..... 417/252
3,291,059 A 12/1966 Werra
4,575,324 A 3/1986 Sommer et al.
5,120,206 A * 6/1992 Greenstreet et al. ..... 418/70
5,252,047 A * 10/1993 Joy ..... 418/132
5,370,514 A 12/1994 Morita et al.
6,390,793 B1 * 5/2002 Sweet et al. ..... 418/132

FOREIGN PATENT DOCUMENTS

JP 60019976 2/1985

OTHER PUBLICATIONS

Oden Corporation, Let Oden's SERVO/fill Put You in the Driver's Seat, Mar. 2001.

(List continued on next page.)

*Primary Examiner*—Thomas Denion
*Assistant Examiner*—Theresa Trieu
(74) *Attorney, Agent, or Firm*—John C. Thompson

(57) ABSTRACT

A sanitary pump with gear shaft bearing blocks in opposed cylindrical portions of a pump body bore, blocks constituting hand removable structural pump ends. Gear shaft bearings extending completely through blocks for easy cleaning, sealed by O-rings and clamp plates. Oval gear cavity bore between cylindrical portions of body bore extends only length of largest of interchangeable gears. Seals at end of gear cavity eliminate entrapment zones. Minimal intrusion of bearing blocks into gear cavity allows large operating temperature range. Shaft seals are contained in a hand removable cartridge. Complete pump disassembly by one manually operated clamp. Gear shaft diameters differ assuring correct assembly. Mount receives pump, tie rods sealing pump and securing to mount. Mount allows pump removal without changing pump-drive alignment. Pin and groove engagement of pump to mount allows 90° interval pump ports orientation. Pump displacement is altered with interchangeable gears and drive end bearing blocks.

34 Claims, 24 Drawing Sheets

OTHER PUBLICATIONS

Oden Corporation, SERVO/FILL Low Cost Volumetric Liquid Filling Systems, 2000.
Waukesha Cherry–Burrell, UG Series Metering Pumps, 1998.
Waukesha Cherry–Burrell, Universal Gear Series PD Pumps, 2000.
Waukesha Cherry–Burrell, Universal UG Series Gear Pumps, 1998.
Waukesha Cherry–Burrell, Universal Series Pumps—Rotary Positive Displacement Pumps, 1997.
Waukesha Cherry–Burrell, Universal II Series Pumps—Rotary Positive Displacement Pumps, 1998.

Roper Pump Company, "S" Series Positive Displacement Sanitary Gear Pump, 1992.

Sine Pump, Sanitary Positive Displacement Pumps, 2000.

Moyno Industrial Products, Moyno 2000 Pumps the Distinct Difference in Pumping Solutions, 1996.

* cited by examiner

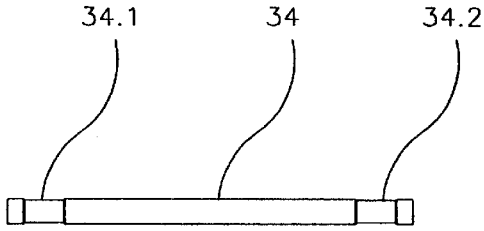
FIG. 7B
Prior Art
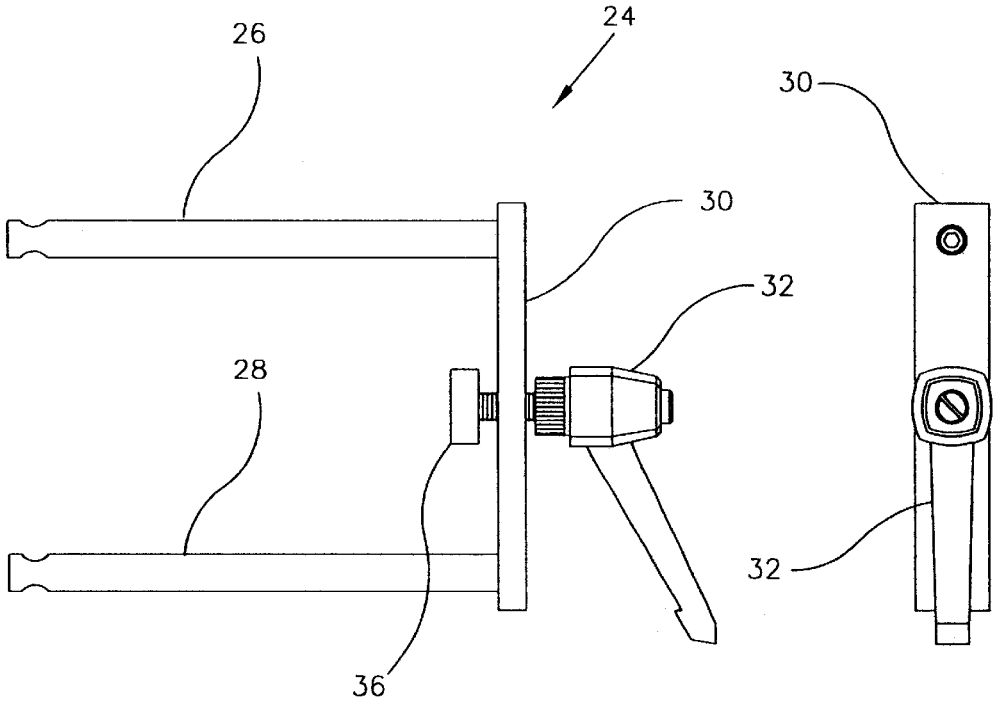
FIG. 7
Prior Art
FIG. 7A
Prior Art

FIG. 17A
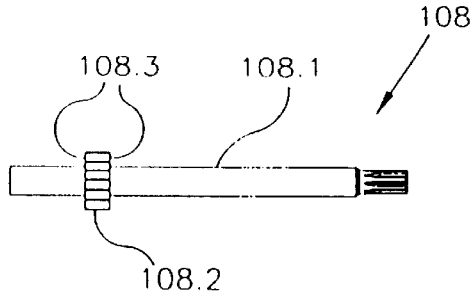
FIG. 17B
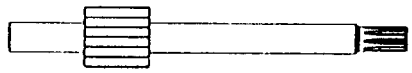
FIG. 17C
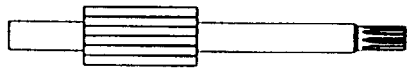
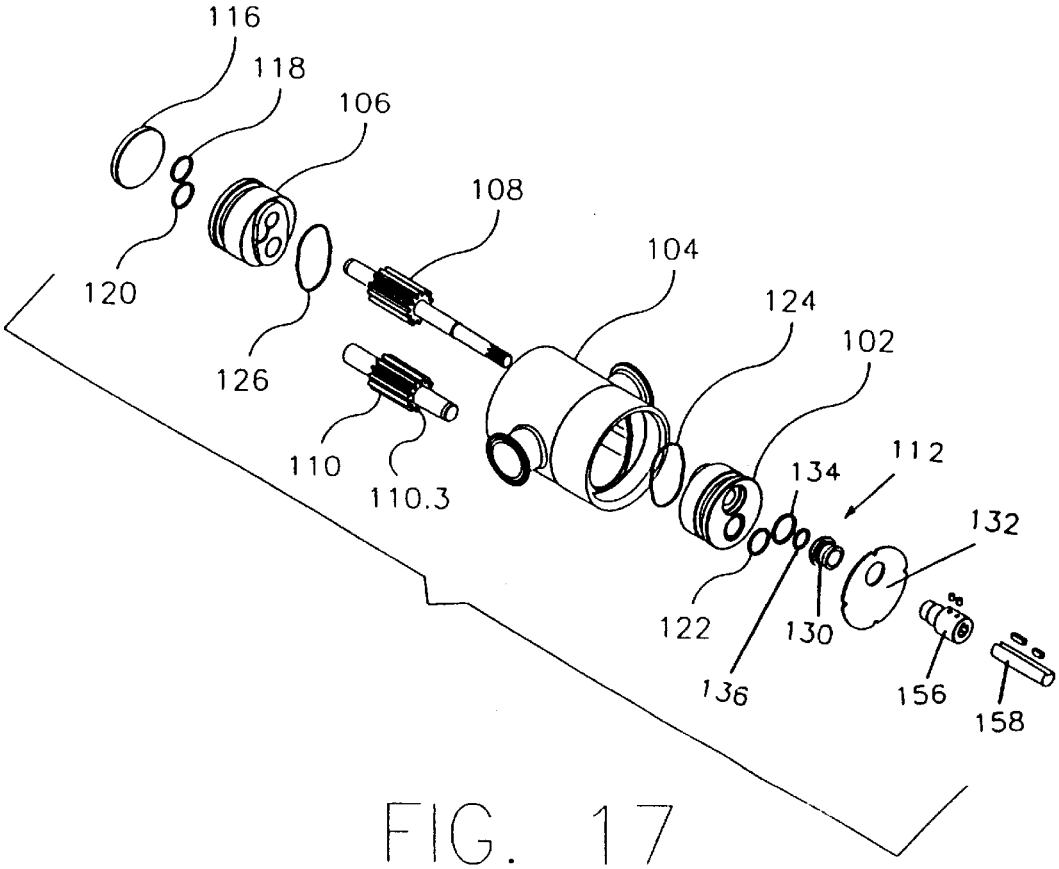
FIG. 17

SANITARY DESIGN GEAR PUMP

CROSS-REFERENCE TO RELATED APPLICATIONS

This application claims priority from U.S. provisional application Ser. No. 60/241,874 filed Oct. 20, 2000.

TECHNICAL FIELD

The present invention relates generally to gear pumps, and more particularly to a sanitary design gear pump in which two gear shaft bearing blocks constitute hand removable structural end bodies of the pump.

BACKGROUND OF THE INVENTION

Among the many types of known rotary positive displacement pumps, gear pumps constitute an old and well developed patent and commercial art. Gear pumps are most frequently found in the patent art and commercial practice as liquid transfer devices and as pressure pumps for hydraulic systems. They are well characterized as to their relative pumping virtues as well as their limitations in application and use. Gear pumps are also employed and well understood as metering pumps and more recently as dosing, dispensing or liquid filling pumps. For example, Oden Corporation of Buffalo, N.Y., USA manufactures a liquid filling machine product known as SERVO/FILL$^e$ which now uses the gear pump of the present invention coupled to a servo controlled motor to define a liquid dose or fill volume based upon the amount of rotation of the gear pump, the flow rate being determined by the rate of rotation of the pump.

Among the applications for rotary positive displacement pumps are the so-called sanitary markets. These include pharmaceutical, biomedical, food, personal care and cosmetics and the like. These sectors are largely served by only a few types of rotary sanitary pumps.

One type is termed a sanitary externally timed rotary lobe pump. This type of rotor pump has an external gearbox which times or positions pump rotors such that they rotate in correct relationship with one another within a pump housing. The rotors are non-contacting but in close tolerance to each other. A variation on this rotor pump type is known as a circumferential piston pump. In either case, these pumps are very expensive by virtue of their complexity and extensive and robust construction requirements. An example of this type of pump is the Universal Series as manufactured by Waukesha Cherry-Burrell of Delavan, Wis., USA.

Another type of rotary positive displacement sanitary pump is termed a Sine pump (U.S. Pat. No. 4,575,324) as manufactured by Sine Pump of Arvada, Colo., USA. The sanitary Sine pump uses a sine wave shaped rotor running through a sliding gate such that a positive pumping action is created. This pump type is very expensive because of the complex shape of the rotor, the close tolerances, robust construction and the expensive materials utilized in its construction.

Still another type of sanitary rotary positive displacement pump is the progressing cavity type as manufactured, for example, by Moyno Industrial Products of Springfield, Ohio, USA. The progressing cavity pump uses a complex helix-like rotor running in close contact and tolerance to a progressing cavity shaped stator. These sanitary pumps are, like the other common types, very expensive by virtue of their complex structures, expensive materials of construction and robust design requirements.

Regardless of the sanitary rotary positive displacement pump type, certain common characteristics can be noted.

Among these are an ability to rapidly tear down or open the fluid flow pathway of the pump for easy and thorough inspection and cleaning, often without the need for tools; the extensive use of stainless steels to assure non-contaminating and non-corroding liquid pumpage contact surfaces; the use of simple sanitary seal structures; the minimization or elimination of areas within the interior of the pump which could cause contamination of the pumpage; low RPM operation for gentle liquid handling; ability to operate at elevated temperatures; an ability to pump liquids ranging from very low viscosity to very high viscosity; and conformance to generally recognized sanitary standards, particularly the Standards For Centrifugal and Positive Rotary Pumps For Milk and Milk Products, 0-09, as promulgated in the US by the 3-A Sanitary Standards Symbol Administrative Council. This standard, which appears as Appendix A to this application, applies not only to dairy uses but also is the de facto standard for most sanitary pump uses.

Notably absent from rotary positive displacement sanitary pump types are gear pumps. This is true in terms of commercial art, and relatively few examples are found in the prior patent art. This may be generally the case because available industrial service (non-sanitary) gear pumps are not designs which are acceptable or easily adaptable for sanitary service. This is also the case even though many such otherwise suitable industrial gear pumps are available with the major fluid flow components such as the pump body, shafts and gears fabricated from materials appropriate to sanitary use, such as stainless steel.

Even though sanitary versions of gear pumps are not generally known in commercial practice, it is nevertheless true that industrial service gear pumps are often used in sanitary applications even though such pumps do not meet generally accepted sanitary standards or regulatory statutes and requirements. This is the case because the gear pump design unto itself is broadly competent in pumping many sanitary liquids, but is much less expensive than true sanitary rotary positive displacement designs available in the marketplace. For one comparative example, a 316 stainless steel industrial gear pump costs less than 33% of the price of the most widely used externally timed sanitary rotary circumferential piston pump of equivalent pumping capability.

It is also widely understood that industrial service (non-sanitary) gear pumps are often used in sanitary applications requiring critical metering or dosing capabilities, these being applications for which precision gear pumps can be more suited than other types of sanitary positive displacement pumps. It is also generally understood that where low or very low flow rates are required, sanitary positive displacement designs are generally commercially unavailable.

It is also to be noted that among knowledgeable and experienced designers of sanitary devices, equipment and pumps there has long been held the general opinion that the external gear type pump is unsuitable for sanitary service and applications because the bearings which support each gear shaft are usually internal to the pump and in contact with the liquid being pumped. This leads to concerns regarding bearing materials suitable to sanitary liquids, and further to the ease of access and cleanability and inspectability of the bearings, which almost always have a depth much greater than diameter or shaft bore.

Because of the limitations presented by sanitary service rotary positive displacement pumps of known type, which are principally economic, and because of the technical and economic need for a gear pump which satisfies and meets the requirements for sanitary service, it is the primary objective of this disclosure to present and describe a unique and novel gear pump of sanitary design. In this regard it is important to note that there are a wide array of uses of gear pumps in general industrial and non-sanitary applications of every type and nature. In many such applications, a gear pump such as that herein disclosed capable of rapid tear down without tools, easy cleaning and inspection, and constructed of corrosion resistant materials, can provide important advantages for rapid changeover of pumpage, elimination of contamination and substantially improved pump productivity. The detailed and numerous particular objects of this invention are set forth further on in this specification.

Numerous rotary positive displacement sanitary pump designs have been set forth in the prior patent and commercial art. The most prominent characteristics of several are herein reviewed by way of technical background.

Dale and Reed (U.S. Pat. No. 2,635,552) teach an externally timed rotary positive displacement rotor pump particularly designed for sanitary service, the pump being provided with studs and wing nuts for rapid removal of the pump housing without tools, and with dowel pins for precision alignment. However, removal of the pumping gears requires the use of tools.

Maisch (U.S. Pat. No. 2,909,124) discloses a gear pump having a housing consisting of three metal discs, aligned by dowel pins and sealed one to the other by O-rings, the pump being particularly designed for sanitary service by virtue of its ease of assembly and disassembly, without the use of tools. In the Maisch disclosure, the driven gear rotates on a fixed shaft and the drive shaft seal is an elastomeric element positioned into a cavity formed by the mating of the center pump body disc and the backing plate disc.

Werra (U.S. Pat. No. 3,291,059) teaches an externally timed rotary positive displacement rotor pump particularly designed for sanitary service, the pump having an ability to be readily disassembled by removal of the pump housing parts from studs, the housing parts being secured by hand removable retaining nuts. Werra further discloses pump impellers which "float" on splined shafts within the pumping cavity thus allowing ready removal from the pump without the use of tools, the impellers being made from a special non-galling high copper alloy, the alloy having a low coefficient of expansion thus allowing close tolerances of the rotors to the pump housing.

Hiroyoki and others (JP 60019976) disclose a gear pump designed to facilitate cleaning. The pump is designed such that the release and removal of a bevel face clamp allows separation of the pump into two sections. One section consists of the pump housing together with the non-drive end gear shaft support bearings. This first section moves outward and away from the drive end of the pump on a set of guides associated with the elevated surface upon which the pump is mounted. The second section consists of the pump gears, the drive end gear support bearings and the drive gear shaft seal assembly. The second section remains fixed to the pump drive assembly by a drive gear shaft coupling member.

Morita and Yamamoto (U.S. Pat. No. 5,370,514) teach an externally timed rotary positive displacement rotor pump designed for sanitary pumping applications in which the pump rotors are fitted to hollow drive shafts and fastened by a long bolt from the drive end of the pump, thus allowing the faces of the pumping rotors to be flat and thereby eliminating any rotor-to-shaft fastener on the face of the rotors. The use of flat-faced rotors eliminates a trap zone within the pump thus improving the sanitary characteristics of the design.

In the prior commercial art, Waukesha Cherry-Burrell of Delavan, Wis. discloses, in a publication entitled "UG Series Gear Pumps" (95-03030, effective October 1998), a gear pump in which the gear shaft support bearings are rolling element bearings which are external to the pump fluid flow pathway, each of the four gear shafts being sealed by a mechanical seal at the point where each shaft penetrates the pump housing. This design results in a fluid flow pathway of minimal liquid volume which is more easily flushed and cleaned in situ, that is without pump disassembly. The pump is thus particularly designed as a clean-in-place device and is not suited for easy or rapid disassembly for cleaning or inspection.

Also in the prior commercial art, Oden Corporation has utilized a gear pump provided by its subsidiary, Niagara Pump Corporation, as a dosing pump in its liquid filling machines. This pump represents a substantial improvement over industrial gear pump designs in terms of incorporation of elements of sanitary design. However, it does not present a complete solution or one that is in compliance as a sanitary pump to the specifications of and design requirements of the 3-A Sanitary Standards Symbol Administrative Council (US) Standard Number 0-09 "Standards for Centrifugal and Positive Rotary Pumps for Milk and Milk Products."

In order to allow and ensure accurate comparison of the cited commercial prior art consisting of the Niagara Pump Corporation provided gear pump utilized by Oden Corporation in its liquid filling machines to the pump of the present invention, Figures showing this prior art are included in this specification. These figures provide a complete and accurate representation of the prior art pump.

OBJECTS AND SUMMARY OF THE INVENTION

It is the primary object of the present invention to overcome the numerous disadvantages and limitations, as set forth above, of the presently known sanitary rotary positive displacement pumps, and to set forth the unique and novel specifications for a sanitary gear pump.

More specifically, the particular and detailed objects of the present invention include:

1. To disclose a unique and novel rotary positive displacement gear pump fully complying with the sanitary design requirements of the 3-A Sanitary Standards Symbol Administrative Council (US) Standard Number 0-09 "Standards for Centrifugal and Positive Rotary Pumps for Milk and Milk Products."
2. To disclose a unique and novel rotary positive displacement sanitary gear pump capable of being offered to the commercial market for a price of no more than fifty to sixty percent of the price of an equivalent sized sanitary pump of prior embodiment.
3. To disclose a unique and novel sanitary gear pump in which the structural end bodies of the pump are the bearing structures, termed bearing blocks, bearing bodies, bearing liners, end liners, or liners, which are used to support and position the pump gears and gears shafts, wherein the gear support bearings are through holes completely piercing the bearing blocks, thus allowing facilitated cleaning and inspection and elimination of any possible trap zones as found in blind hole bearings.
4. To disclose a unique and novel sanitary gear pump in which the through hole bearings are end sealed using seal rings and a simple seal plate applied against the outer face of the bearing block. The seal rings can be of essentially any type including gaskets, flat ring, O-ring, Vee ring, U-cup and the like. The clamp plate can also be termed an end plate, a seal plate, a liner end cap, or a retainer plate.

5. To disclose a unique and novel sanitary gear pump in which the static gear shaft seal ring glands located on the outside face of the bearing blocks are sized to grip the seal rings during the pump assembly process thereby easing and simplifying pump assembly.

6. To disclose a unique and novel sanitary gear pump in which the through hole bearing design allows the bearing length to be much longer than the gear shaft diameter without impairment of cleanability of the device.

7. To disclose a unique and novel sanitary gear pump in which the bearing block to body seal arrangement allows seal disengagement immediately upon the start of withdrawal of the bearing block from the pump, thus greatly easing hand or manual pump disassembly by reducing and breaking the vacuum formed by such bearing block withdrawal.

8. To disclose a unique and novel sanitary gear pump in which the length of the pumping cavity is defined by the distance between the face of pilot portions of opposed bearing blocks, which pilot portions are received in each end of the gear cavity bore when fully assembled.

9. To disclose a unique and novel sanitary gear pump in which the bearing blocks comprising the structural end bodies of the pump extend into the gear cavity bore of the pump only to the degree necessary to form two sides of a seal ring gland and capture and align the bearing blocks and gears coaxially within the pump.

10. To disclose a unique and novel sanitary gear pump in which gear cavity bore end seals arranged in a gland immediately adjacent but external to the end of the net bore shape of the gear cavity bore maximizes the bearing block to pump body direct contact square area thereby maximizing the assembled pump's dimensional accuracy, stability and durability.

11. To disclose a unique and novel sanitary gear pump in which the square area of the circular flange-like face to face engagement of the bearing blocks and pump body is maximized by the gear cavity bore to bearing block seal placement, thus substantially reducing the possibility during pump assembly of over-tightening the bearing blocks into the gear cavity bore of the pump, thus assuring that a correct and defined distance is established and repeatably maintained between the pump bearings and the pump gear faces, regardless of assembly clamping force.

12. To disclose a unique and novel sanitary gear pump in which the bearing block to gear cavity bore seal arrangement minimizes the pump assembly mating force required to correctly compress each seal ring in the pump.

13. To disclose a unique and novel sanitary gear pump in which the end body bearing blocks enter into the gear cavity bore of the pump for a distance that is approximately equivalent to the diameter of the bearing to body seal element for the longest gears which may be received by the gear cavity bore.

14. To disclose a unique and novel sanitary gear pump in which the bearing block to gear cavity bore seal arrangement allows bearing block to pump body assembly free of seal ring rolling, cutting, or distortion and without risk of the seal ring becoming unseated from its gland.

15. To disclose a unique and novel sanitary gear pump in which the bearing block to gear cavity bore seal arrangement increases the ability of the bearing blocks to resist dimensional distortion due to cold flow.

16. To disclose a unique and novel sanitary gear pump in which the bearing block to gear cavity bore seal arrangement confers the ability of the non-drive end bearing block to be assembled into the pump body such that rotation to correct orientation and seating is signified by both a perceptible audible and a perceptible tactile telltale.

17. To disclose a unique and novel sanitary gear pump in which the thermal expansion of the bearing blocks with increasing pump temperature results in dimensional increase predominantly to the portion of the block outside of the gear cavity bore thus allowing a usable gear face to bearing face tolerance to be maintained without contact over a useful temperature range of at least 270° F.

18. To disclose a unique and novel sanitary gear pump in which the bearing block to gear cavity bore arrangement prevents pumped liquid from coming into contact with the flange faces of the pump body and bearing blocks, thus eliminating a liquid trap and contamination zone, thus enhancing the sanitary design of the pump.

19. To disclose a unique and novel sanitary gear pump in which the seal glands located at the ends of the gear cavity bore are established, formed and defined by the gear cavity bore and bearing block such that the seal element within the gland is properly and repeatably compressed when the bearing block is installed and clamped into the pump body, but cannot be overcompressed because of the bearing block face to pump bore face engagement method.

20. To disclose a unique and novel sanitary gear pump in which the drive gear dynamic shaft seal arrangement is comprised of a single cartridge assembly which is removed from and installed onto its shaft by manually gripping or grasping a flange or grip or groove constituting the external end structure of the seal cartridge. The seal cartridge assembly may also be alternatively and equivalently termed the seal assembly, the seal gland, the seal assembly housing or the seal can.

21. To disclose a unique and novel sanitary gear pump in which the drive gear dynamic seal cartridge is retained in and sealed to the bearing block by a static seal ring and a simple shaft seal clamp plate applied against a flange on the seal cartridge and the outer face of the bearing block, the clamp plate being held in place by the pump assembly means. The stationary seal rings can be of essentially any type, including gasket, flat ring, O-ring, Vee ring, U-cup and the like.

22. To disclose a unique and novel sanitary gear pump in which the drive gear dynamic shaft seal assembly allows interchangeable use of numerous dynamic drive gear shaft seal methods including square ring, quad ring, O-ring, Vee ring, U-cup, internal mechanical, external mechanical and packing seals, all types using the same circumferential cartridge to bearing block seal ring, and retaining the same seal housing outside diameter.

23. To disclose a unique and novel sanitary gear pump in which the drive gear dynamic shaft seal assembly means precludes leakage resulting from a change in seal assembly position or location when the pump is in assembled condition.

24. To disclose a unique and novel sanitary gear pump in which the drive gear dynamic shaft seal assembly is prevented from rotating by locking male and female D-shaped elements on the seal housing and seal clamp plate respectively.

25. To disclose a unique and novel sanitary gear pump in which the pump body orientation in the pump mount is precisely established and maintained by a simple and robust pin and groove arrangement, such that four locator slots or channels are provided at ninety degree intervals at the drive end of the pump body, each slot being shaped to provide a contoured or tapered guide for easy engagement with the mating pin. The mating pin is located in the pump mount and allows selection of pump port orientation in any of four possible locations, at ninety degree intervals of rotation.

26. To disclose a unique and novel sanitary gear pump in which the pump mount consists of a fixed cylindrical element into which the drive end bearing block and a portion of the pump body inserts for precise and repeatable orientation and location. The mount has integral pump assembly binding tie rods (also termed draw bars) and the mount foot is reverse of the cylinder portion in an "open Z" form, thus allowing a fully overhung pump mount in which the pump ports are unobstructed by the mount.

27. To disclose a unique and novel sanitary gear pump in which the pump mount, when aligned to a pump drive, allows the pump to be repeatedly removed from the mount and reinstalled into the mount without any loss of or change in pump to drive alignment. The pump to mount engagement means further allows the removal of pump from any given mount and replacement by any other pump of the same model into the mount without any loss of pump-mount-drive alignment.

28. To disclose a unique and novel sanitary gear pump in which the pump is attached to its mount by use of two tie rods one of which carries a captured cross bar which swings across to and engages with the second tie rod, a single hand operated threaded fastener (termed the adjustment screw, the assembly screw, or the binder screw), this element then being tightened upon the center of the non-drive end seal plate to effect complete pump assembly, sealing and location, all without the need for or use of tools of any sort.

29. To disclose a unique and novel sanitary gear pump in which the assembly of the pump bearing blocks, pump gears and pump body as well as the assembly of the drive gear shaft dynamic seal assembly as well as the mounting and sealing of all constituent pump components is achieved with a single hand operated fastener device.

30. To disclose a unique and novel sanitary gear pump in which the pump assembly hardware remain captured and attached to the integral pump mount when the pump is in a disassembled condition.

31. To disclose a unique and novel sanitary gear pump in which the centered application of binding force by the single threaded clamping fastener acting on binding bars attached to the pump mount assures that a truly centered and balanced coaxial assembly force is applied through the entire pump structure.

32. To disclose a unique and novel sanitary gear pump in which the pump assembly may be automatically sealed and retained in its mount using hydraulic, pneumatic or motor driven means, with electronic sensing of status.

33. To disclose a unique and novel sanitary gear pump in which the spline coupling drive shaft design in combination with the pump mount allows removal of the pump from its mount without the requirement to remove any shaft to drive coupling. The splined gear drive shaft also allows the drive gear to be removed from the pump without the requirement to remove any drive coupling.

34. To disclose a unique and novel sanitary gear pump in which the use of different shaft diameters for the drive and driven gears precludes incorrect assembly of the pump.

35. To disclose a unique and novel sanitary gear pump in which the use of different length bearing blocks for the drive and non-drive pump ends precludes incorrect assembly of the pump.

36. To disclose a unique and novel sanitary gear pump in which the bearing block design allows reconfiguration of the pump at any time to vary displacement by simple and economical substitution of gears of alternate length along with the drive end bearing block of appropriate corresponding length.

37. To disclose a unique and novel sanitary gear pump in which the pump may be readily reconfigured to vary displacement by the simple substitution of gears of alternate length in combination with a pump body of appropriate corresponding length, the bearing blocks of the pump remaining unchanged.

38. To disclose a unique and novel sanitary gear pump in which the spline end of the drive gear shaft is reduced in diameter to be less than the diameter of the shaft in the pump shaft seal area with a smooth tapered transition between the two diameters for the purpose of assuring simple and easy seal installation onto and removal from the shaft with lowered risk of damage to the shaft seal element.

39. To disclose a unique and novel sanitary gear pump in which the drive gear shaft can be particularly hardened to withstand the wear effects exerted upon the shaft by rotation against a shaft sealing ring, U-cup, Vee ring, or packing or similar seal arrangement.

40. To disclose a unique and novel sanitary gear pump in which the minimal penetration of the pump gear bearings into the gear cavity bore of the pump greatly reduces the circumferential leakage pathway between the bearing blocks in the gear cavity bore and the wall of the gear cavity bore.

The foregoing objects of this invention, as well as other objects and advantages of this invention, will be more fully appreciated after a consideration of the following detailed description taken in conjunctions with the accompanying drawings in which a preferred form of this invention is illustrated.

BRIEF DESCRIPTION OF THE DRAWINGS

FIGS. 7 to 7B shows the assembly hardware of the pump of the prior art embodiment sold by Niagara Pump.

FIG. 17 shows an exploded perspective view of the pump assembly of the preferred embodiment of this invention, the pump mount and assembly hardware being omitted.

FIGS. 17A–17C show three differing size drive gear assemblies which may be used with corresponding size driven gear assemblies, differing size gear assemblies requiring differ size bearing blocks.

FIG. 23B shows a side centerline section view of the shaft seal cartridge of the pump of the preferred embodiment of this invention, this view being taken generally along the line 23B—23B in FIG. 23A.

DETAILED DESCRIPTION

Figure 1:
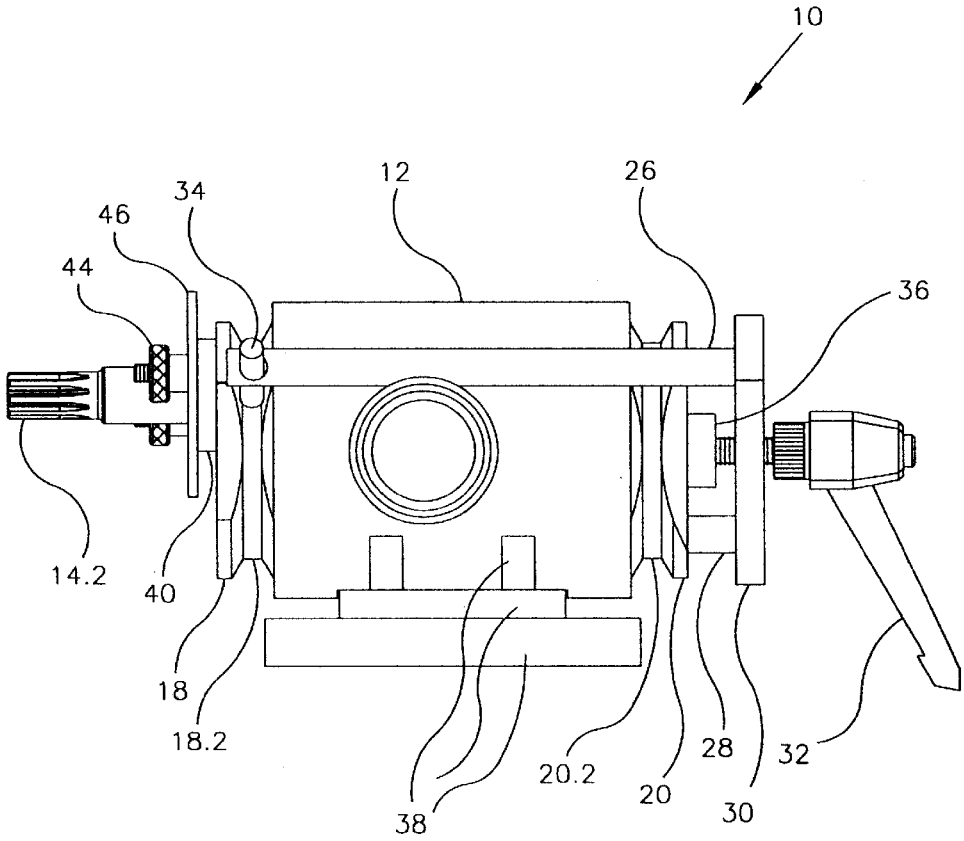
FIG. 1 Prior Art
FIG. 1 shows a side view of the assembled pump of the prior art embodiment sold by Niagara Pump.
Figure 2:
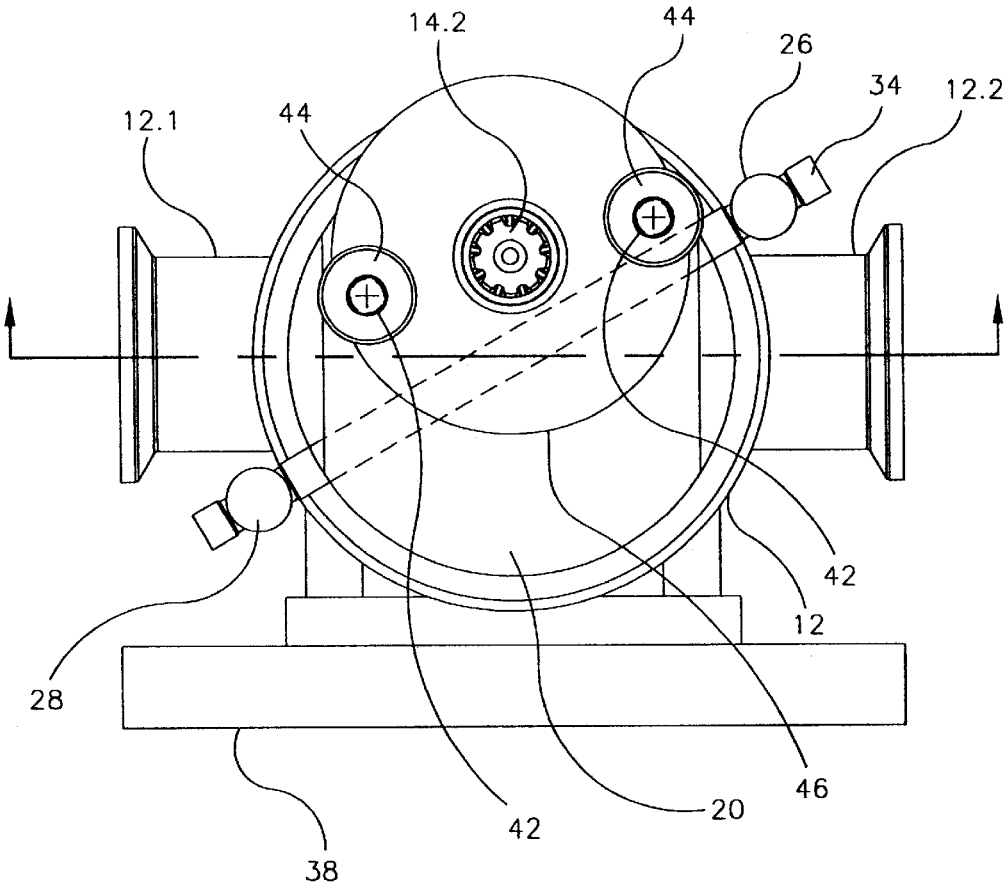
FIG. 2 Prior Art
FIG. 2 shows a drive shaft end view of the assembled pump of the prior art embodiment sold by Niagara Pump.
Figure 3:
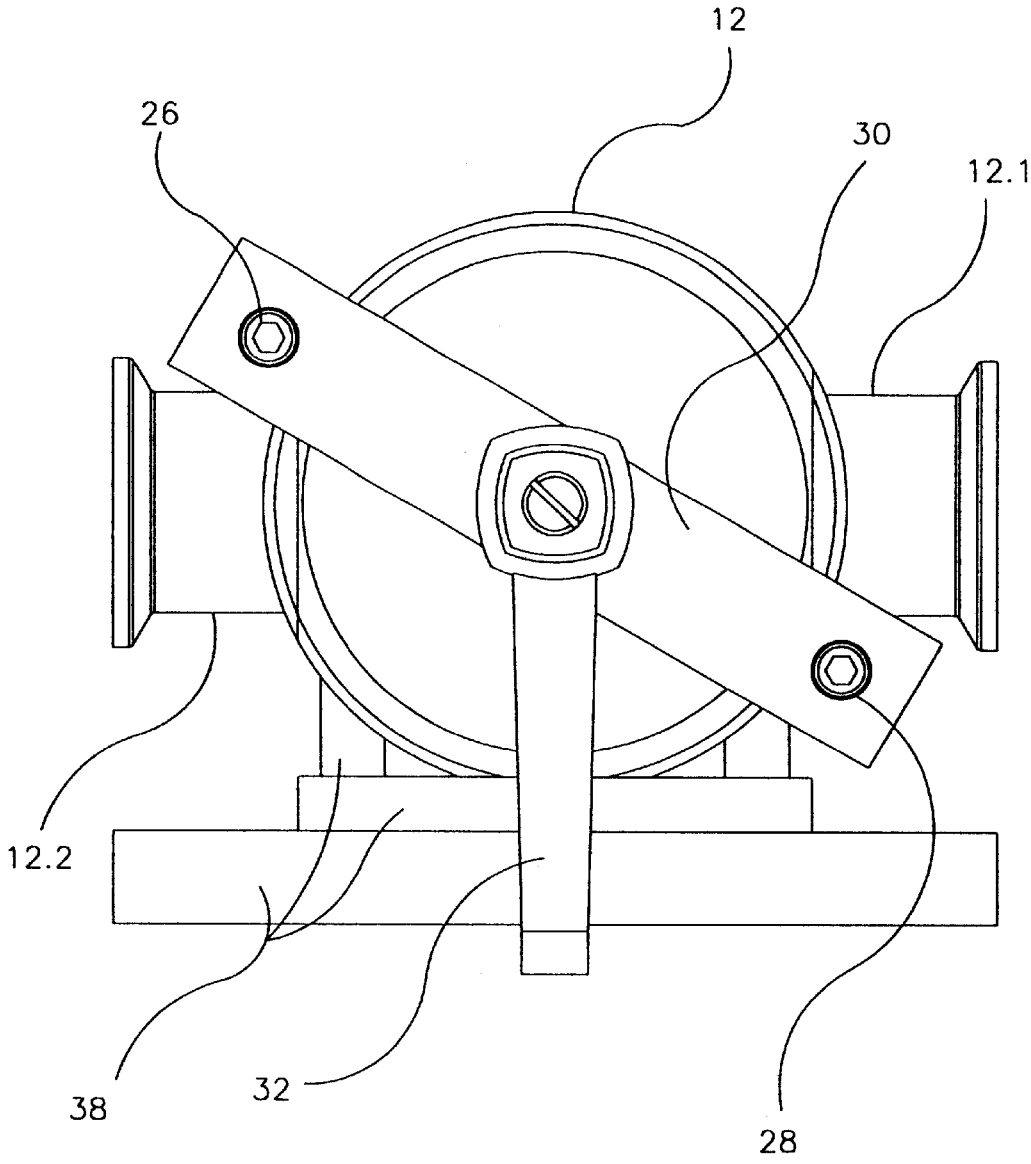
FIG. 3 Prior Art
FIG. 3 shows a non-drive end view of the assembled pump of the prior art embodiment sold by Niagara Pump.
Figure 4:
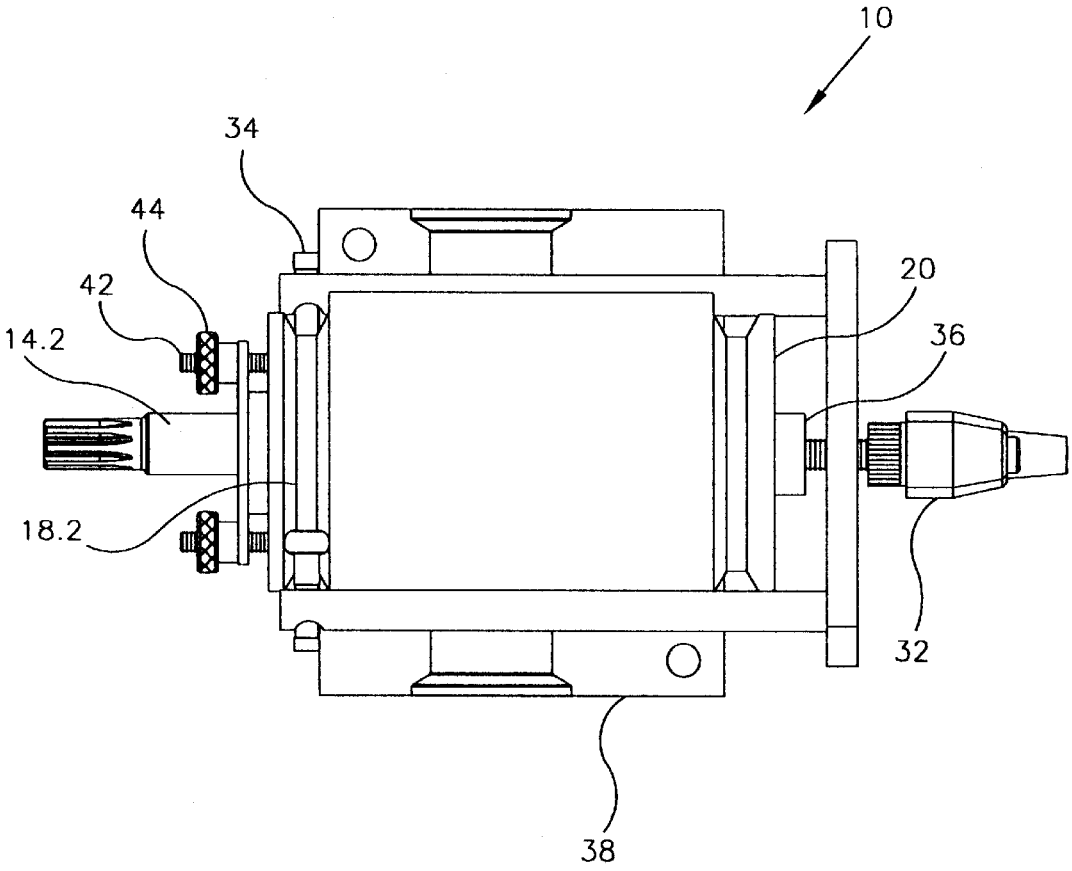
FIG. 4 Prior Art
FIG. 4 shows a top view of the assembled pump of the prior art embodiment sold by Niagara Pump.

The Prior Art Shown in FIGS. 1–9B

The prior art pump shown in FIGS. 1–9B is a sanitary gear pump, indicated generally at 10. The major components of the pump 10 include a pump body 12, drive and idler gear assemblies 14, 16, respectively, and gear shaft bearing blocks 18, 20. The pump body has an inlet and an outlet 12.1 and 12.2 which are interchangeable depending upon the direction of rotation of the gear assemblies. Each of the gear assemblies includes a gear 14.1 or 16.1, and a shaft 14.2 or 16.2. As can be seen, one end of the drive shaft has spline for connection to a suitable drive. The gear shaft bearing blocks 18, 20 comprise the drive and non-drive structural ends of the pump, respectively, with these elements also serving as bearing supports for the drive and idler gear shafts 14.2 and 16.2. The positioning of the bearing blocks 18, 20 in the generally oval shaped gear cavity bore 22 (FIG. 6) of the pump body defines the axial dimensions of the pumping cavity. This cavity has circumferential dimensions allowing close but non-contacting rotation of the meshed gears 14.1 and 16.1 within the housing. The bearing faces 18.1 and 20.1 are positioned in close tolerance to the gear faces thus creating a gear cavity bore having a net bore and axial dimensions suitable for pumping. The bearing blocks 18 and 20 are also readily removable from the pump body for pump disassembly and cleaning. As can be seen from FIG. 5A, the pump gear shaft bearing holes in the bearing blocks of the prior art pump do not pass entirely through the block, but rather are blind. The gear cavity bore is sealed by seal rings 18.3 and 20.3, in the form of O-rings, which are carried by circumferential seal glands, as can be seen from FIGS. 5 and 5A.

The pump assembly hardware is entirely separate from the pump mount. The pump is so designed that it can be assembled and disassembled by hand. To this end the bearing blocks 18 and 20 are provided with a circumferential grip grooves 18.2 and 20.2 for ease of hand removal and installation. The prior art pump is assembled and retained together as a working unit by use of a fork shaped assembly 24 (termed the binder fork and best shown in FIG. 7) consisting of two round binder bars 26, 28 fixed to a flat cross bar 30 which carries a single threaded ratchet handle binder and tightening element 32. On the drive end gear shaft bearing block the pump, a round locking bar 34 is found which passes freely through a clearance hole 18.4 in the shaft end bearing block 18 and through oversized clearance holes (no number) in the two binder bars. The locking bar clearance hole 18.4 through the bearing block 18 is centered thus passing through the circular center of the structure. With this assembly apparatus, the pump 12, 14, 16, 18 & 20 can be first loosely assembled. Then, the binder fork 24 is fitted over the non-drive end of the pump with the ratchet handle binding fastener backed off. The locking bar 34 is passed first through the hole in one binder bar, then through the clearance hole 18.4 in the bearing block 18, then through the hole in the second binder bar. The locking bar is provided with machined relief areas 34.1, 34.2 where it is undercut, these serving to position the locking bar relative to the binder bars. The binder fork and the locking bar are pictured together in FIG. 1. After the pump clamping hardware is assembled onto the pump as described, the ratchet handle 32 is rotated to tighten the force spreading disc into a matching relief area 20.4 provided in the outboard face of the non-drive end bearing block 20. This disc guarantees centering of the binding hardware on the non-drive end of the pump.

The mounting arrangement for the prior art pump consists of a conventional and well known pedestal 38. It can be affixed to the pump body in any conventional manner.

The drive shaft seal of the pump is a captured O-ring design, with the entire seal housing and O-ring assembly 40 being affixed to the pump by use of threaded studs 42 and knurled nuts 44 in conjunction with a seal backer disc 46. The seal and its mount hardware are entirely separated from the pump assembly hardware, and the pump mounting hardware, which are also discrete one from the other.

The Preferred Embodiment Shown in FIGS. 10–23

The present invention consists of a unique and novel sanitary design gear pump providing solutions to the problems associated with using gear pumps in sanitary applications.

The present invention provides a sanitary gear pump which is low in cost, simple and robust in construction, contains few parts, is readily disassembled for cleaning and inspection without the use of tools, has a very wide operating temperature range, has a simple and versatile shaft seal arrangement, provides for multiple mount orientations, can be mounted and dismounted without loss of drive alignment, and allows dismount, tear down, re-assembly and re-mount with the use of only one hand operated screw fastener. All of these features are unique and novel in their embodiment, and are fully illustrated and described in detail herein.

As can best be seen from FIGS. 10, 12, 13 and 17, the preferred embodiment consists generally of a sanitary gear pump indicated generally at 100. It is comprised of seven major elements: the drive end bearing block 102; the pump body or housing 104; the idler or non-drive end bearing block 106; the drive and idler gear assemblies indicated generally at 108 and 110, respectively; the drive gear shaft seal assembly 112; and the pump mount and assembly hardware 114. Each of the gear assemblies 108 and 110 includes a gear 108.2 or 110.2 mounted upon a shaft bearing 108.1 or 110.1, respectively.

Figure 12:
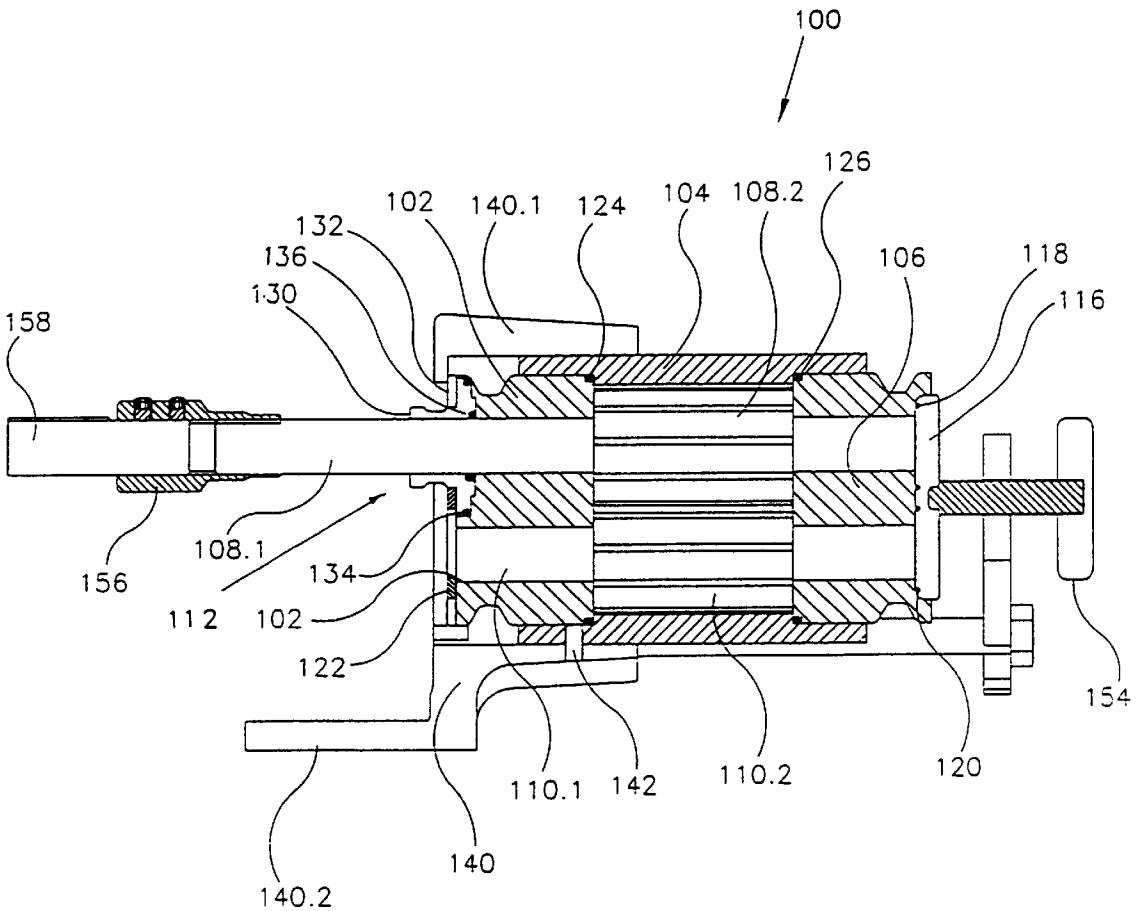
FIG. 12 shows a side view of the fully assembled pump of the preferred embodiment of this invention in partial axial section along the vertical centerline of the pump.

As illustrated in FIGS. 12 and 17, the bearing blocks 102, 106 comprise the drive end and non-drive structural ends of the pump respectively, as well as serving as bearing supports for the drive and idler gear shafts 108.1 and 110.1. This method of pump construction leads to unique and novel attributes in the pump of the present invention, as will be detailed further on in this specification.

The pump body or housing 104 is provided with a pump body bore consisting of a centrally located gear cavity bore or oval bore 104.1, and cylindrical portions 104.2 and 104.3 to either side, which receive the pump bearing blocks 102, 106. As can be seen in FIG. 12, the positioning of the bearing blocks 102, 106 in the bore of the pump body 104 defines the axial dimensions of the cavity in which the gears rotate. This gear cavity bore consists of the generally oval shaped bore 104.1 (FIG. 19) which has circumferential dimensions allowing close but non-contacting rotation of the meshed gears 108.2, 110.2 within the housing. The inside bearing faces 102.1, 106.1 of bearing blocks 102, 106 are positioned in close tolerance to the gear faces 108.3, 110.3, thus creating a gear cavity bore having a net bore and axial dimensions suitable for pumping.

Figure 19A:
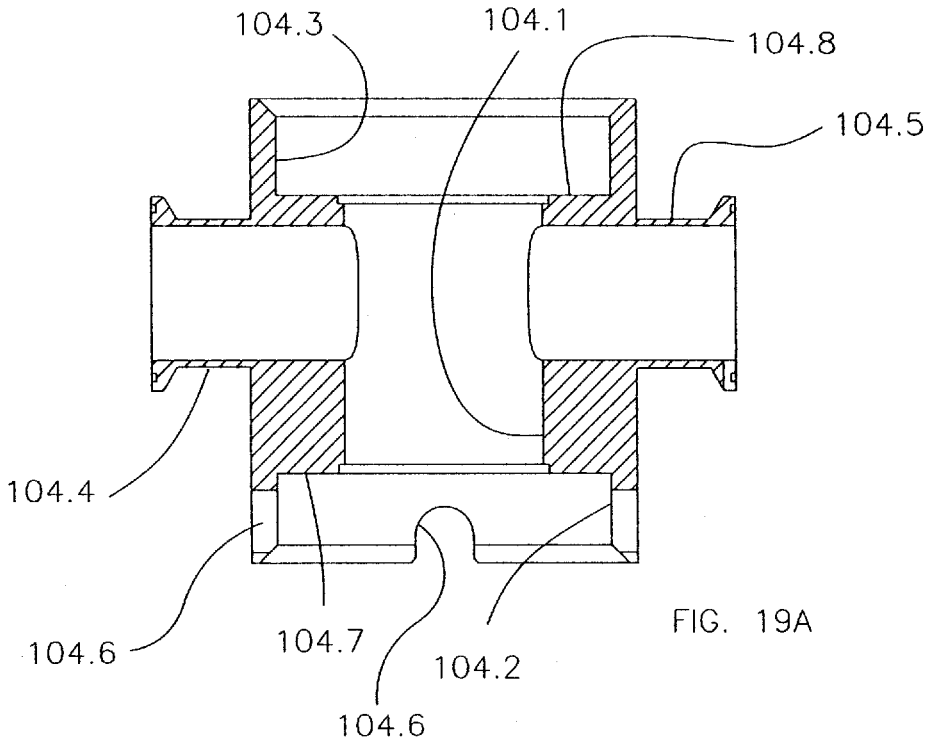
FIG. 19A shows a horizontal centerline section view of the pump body of the pump of the preferred embodiment of this invention, this view being taken generally along the line 19A—19A in FIG. 19.
Figure 19:
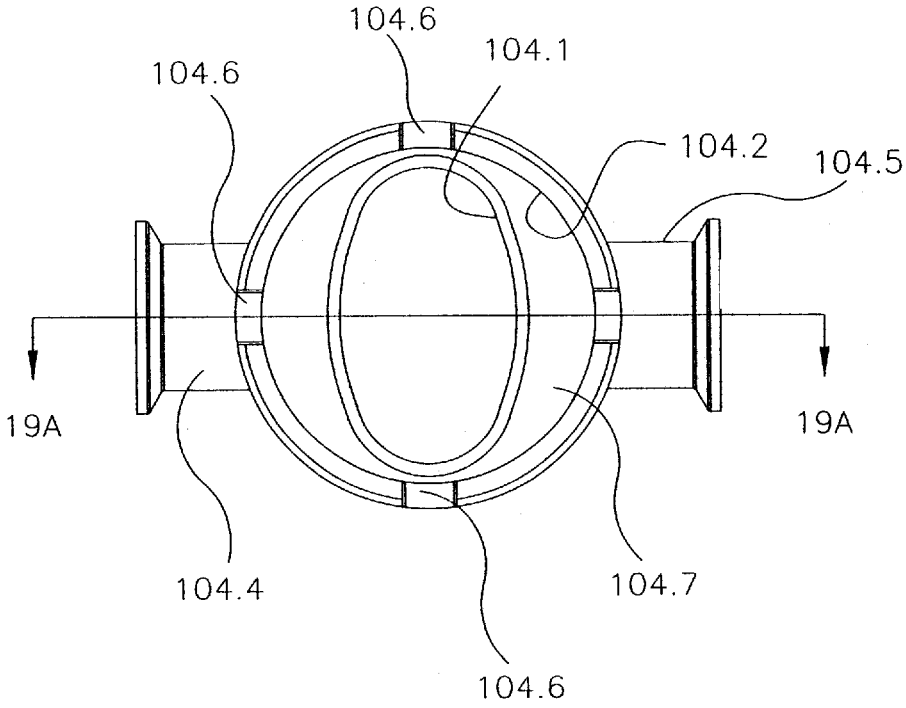
FIG. 19 shows an end view of the pump body of the pump of the preferred embodiment of this invention.

FIG. 19 provides an end view of the pump body 104 which shows the dual shape of the housing where the gear cavity bore 104.1, which is shaped to take the pumping gears, is bounded on each end by the circular or cylindrical portion 104.2 and 104.3, (FIG. 19A). This provides bearing block to body engagement with large square area flat surfaces, which allows simple and precise alignment and spacing of the bearings, gears and housing. The particular and unique aspects of this construction will be detailed further on. The pump body 104 can be constructed of any suitable rigid material, some typical examples being 316L grade stainless steel, titanium, Hastalloy, Carpenter 20, ceramics, as well as various plastics.

Figure 22A:
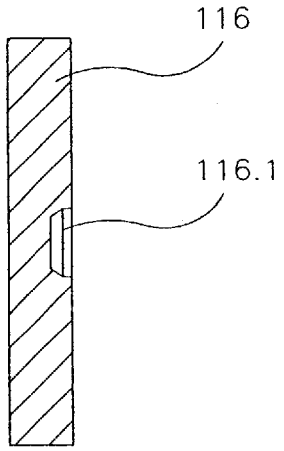
FIG. 22A shows a side centerline section view of the non-drive end clamp plate shown in FIG. 22, this view being taken generally along the line 22A—22A in FIG. 22.
Figure 22:
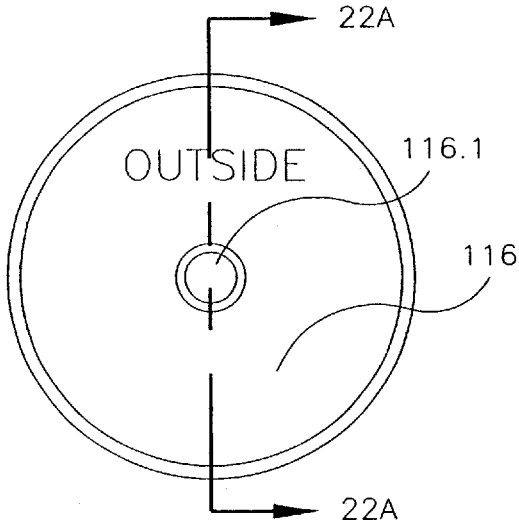
FIG. 22 shows an outside face view of the non-drive end clamp plate for the pump of the preferred embodiment of this invention.
Figure 24:
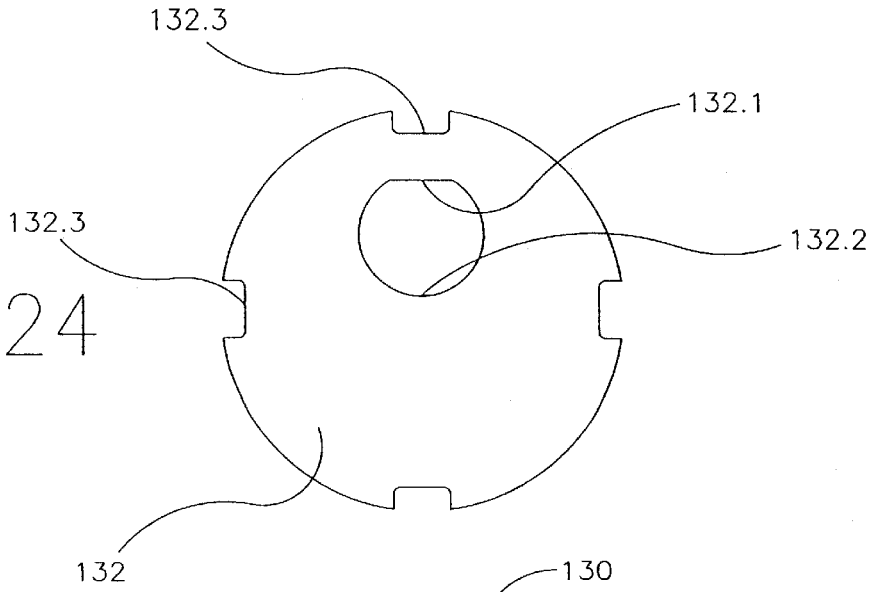
FIG. 24 is a view of the drive end clamp plate.

Referring to FIGS. 17, 22 and 22A, the idler or non-drive end seal plate 116 is pictured. This can also be termed the liner end cap. This disc is generally made from 316L stainless steel or other appropriate material. The seal plate serves to prevent liquid leakage from the non-drive end gear shaft bearings which novelly penetrate essentially completely through the bearing block 106. The seal of each shaft bearing is achieved using two identical seal rings in the form of O-rings 118, 120 received in suitable glands (no number) on the outer face of block 106. (In an alternate version, not shown, a single seal ring inclusive of the outside diameter of both shaft holes can be utilized to end seal these non-drive end bearing block shaft through holes.) A recess 106.2 is provided in the non-drive end bearing block 106 for the seal plate 116 allowing easy and positive positioning of this plate upon re-assembly of the pump. It is also a unique feature of the pump that the glands for rings 118 and 120 are purposely cut to a diameter smaller than typical for a given size seal O-ring 118, 120, thus allowing the seal rings to grip the gland sufficiently to prevent the seals from falling out during pump assembly and disassembly, even when they are not captured by the seal plate. It should be noted that the drive end bearing block 102 has the same novel attributes with regard to the gear shaft bearing through holes and means of sealing, differing only in the drive gear shaft seal structure which will be discussed further on. Thus, bearing block 102 has a suitable gland for receiving O-ring 122.

The through hole geometry of the bearing blocks 102, 106 is unique and novel to the preferred embodiment of the pump of the present invention. Because the pump is intended to be frequently dismounted and disassembled for cleaning and inspection, any improvement to the geometry or form of the pump which improves or facilitates cleaning and inspection is of merit. Thus in FIG. 20A, a section view of the non-drive end bearing block shows the simple, easy to clean and examine design of this novel aspect of the present invention. The gear shaft holes extend from one face of the bearing block to the other, with large seal ring glands at the outside face of each. In this regard, it is notable that the length of the bearing shaft journals can be much longer than the shaft diameter without compromising cleanability. This is not the case where blind bearing holes are concerned, such as in the design described in the prior art section of this specification. This enhanced access for cleaning, in turn, allows a design with very large and robust bearing support structure, improving the longevity and pressure range of the pump, without compromising cleanability of the device.

As briefly noted earlier, the bearing block 106 serves as the structural end body of the non-drive end of the pump. The block, also termed a bearing body, bearing liner, end liner, idler end liner or simply liner, is shaped to be hand inserted and removed from the pump body or housing by use of the circumferential external groove 106.3 near the outboard end of the liner. This groove allows an easy and efficient finger grip on the liner such that it can be readily pulled from the pump body or reinserted into it. It is to be understood that many other shapes can serve this particular purpose, including the use of a flange face on the outboard end of each block, as well as convolutions, grip holes, a knurled finish, pull knobs and the like. Block 102 has a similar groove 102.3. The bearing blocks can be constructed of any suitable material, most typical being glass filled Teflon, Teflon, UHMW plastics, PEEK plastics, acetyl plastics, PE plastics, PP plastics, PPS plastics, various ceramics, as well as corrosion resistant metals such as brass, bronze, 300 series stainless steels, nitronic non-galling alloys, Waukesha 88 non-galling stainless steel alloy, and other non-galling alloys.

Figure 20:
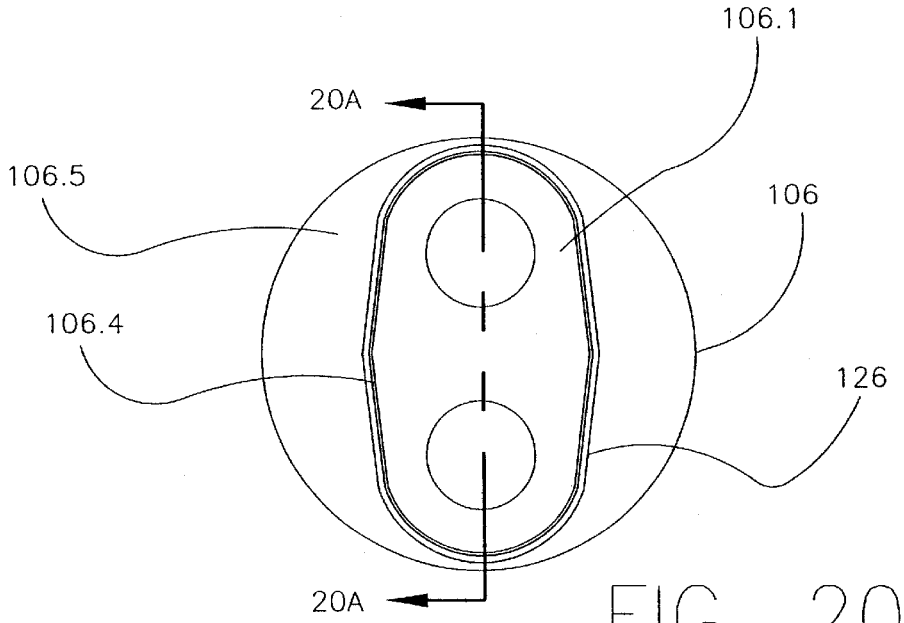
FIG. 20 shows a gear face view of the non-drive end bearing block of the pump of the preferred embodiment of this invention.
Figure 20A:
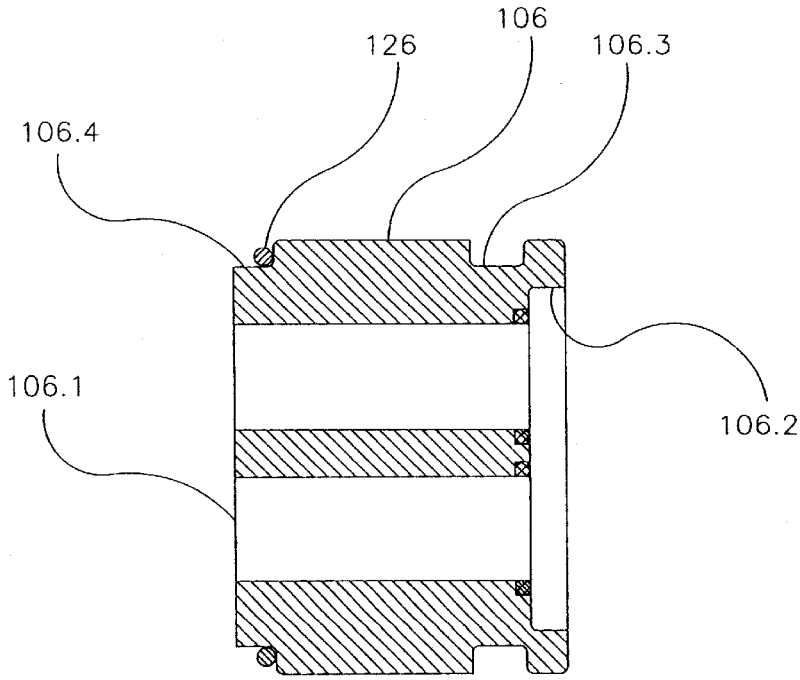
FIG. 20A is a sectional view taken generally along the line 20A—20A in FIG. 20.

The inboard end 102.4, 106.4 of the bearing blocks 102, 106, respectively, as best shown in FIG. 20 with respect to block 106, is uniquely shaped to precisely match and fit into the internal contour of the gear cavity bore 104.1 of the pump, with which it engages in an assembled condition. It is important to understand that most of the bearing block is an uncomplicated cylindrical shape, making it simple and low cost to manufacture. similarly, the cylindrical portions 104.2 and 104.3 of the pump body 104 are round in shape, this being also simple and low in manufacturing cost when compared with the cost of continuing the gear cavity bore for the entire length of the pump housing. Thus, this design allows precision engagement and alignment of the bearing block into the gear cavity bore of the pump housing as is required to precisely position the gears with minimal precision cutting or machining of the gear cavity bore or corresponding bearing block shape.

The arrangement of the pump bearing blocks 102, 106 and housing 104 confers numerous important attributes to the pump of the present invention. The first attribute is that the positioning of the bearing block in the pump housing is defined by the flat mating faces 102.5, 106.5 or partial flange like surfaces formed by the circular portion of the bearing block and the circular portion 104.7 and 104.8 of the pump bore. These two faces 102.5 and 104.7 and also 106.5 and 104.8 abut each other during assembly and thus define in a highly accurate and repeatable and stable way the axial dimensions of the gear cavity bore. The accuracy of the gear cavity bore in an external gear pump such as that of the present invention is crucial to the pumping efficacy and efficiency of the device. Thus, the distance from the non-drive end bearing gear cavity bore face to the gear cavity bore face of the drive end bearing must be very defined and repeatable with many cycles of assembly and disassembly. The larger the square area of these described mating surfaces the better the control of this critical dimensional relationship with the wear and tear of frequent assembly/disassembly of the pump of the present invention. The novel means to maximize this square area of bearing block to pump body engagement in a given size pump of the present invention will be set forth presently.

The novel method of maximization of the bearing blocks to pump body mating square area as described further on provides another unique and novel attribute, namely, the ability of the bearing blocks to withstand distortion or deformation due to over-tightening against the pump gear cavity bore end faces. This resistance to such distortion or overcompression or crushing then prevents overtravel of the bearing blocks into the pump gear cavity bore or misalignment of the gear shaft bearing holes relative to the gear shafts. Essentially, the maximization of the square area of engagement defined by the novel geometry disclosed below enhances the bearing blocks ability to be directly acted upon by the pump assembly and binding hardware without risk of loss of dimensional definition or precision. This characteristic of the novel design is especially important when the bearing blocks are fabricated from filled Teflon or various plastics.

The unique and novel attribute of the bearing block to pump housing geometry of this embodiment concerns the location of the gear cavity bore end seal element 124 or 126 between each bearing block 102 and 106, respectively, and the housing 104. It is the placement of the gear cavity bore end seal in the location herein disclosed which allows maximization of the area of engagement of the bearing blocks to the pump housing thus, in turn, conferring the advantages described above. In addition to these described advantages, the novel seal location confers important sanitary advantages as well as mechanical assembly advantages, both of which will be presently disclosed.

Figure 5:
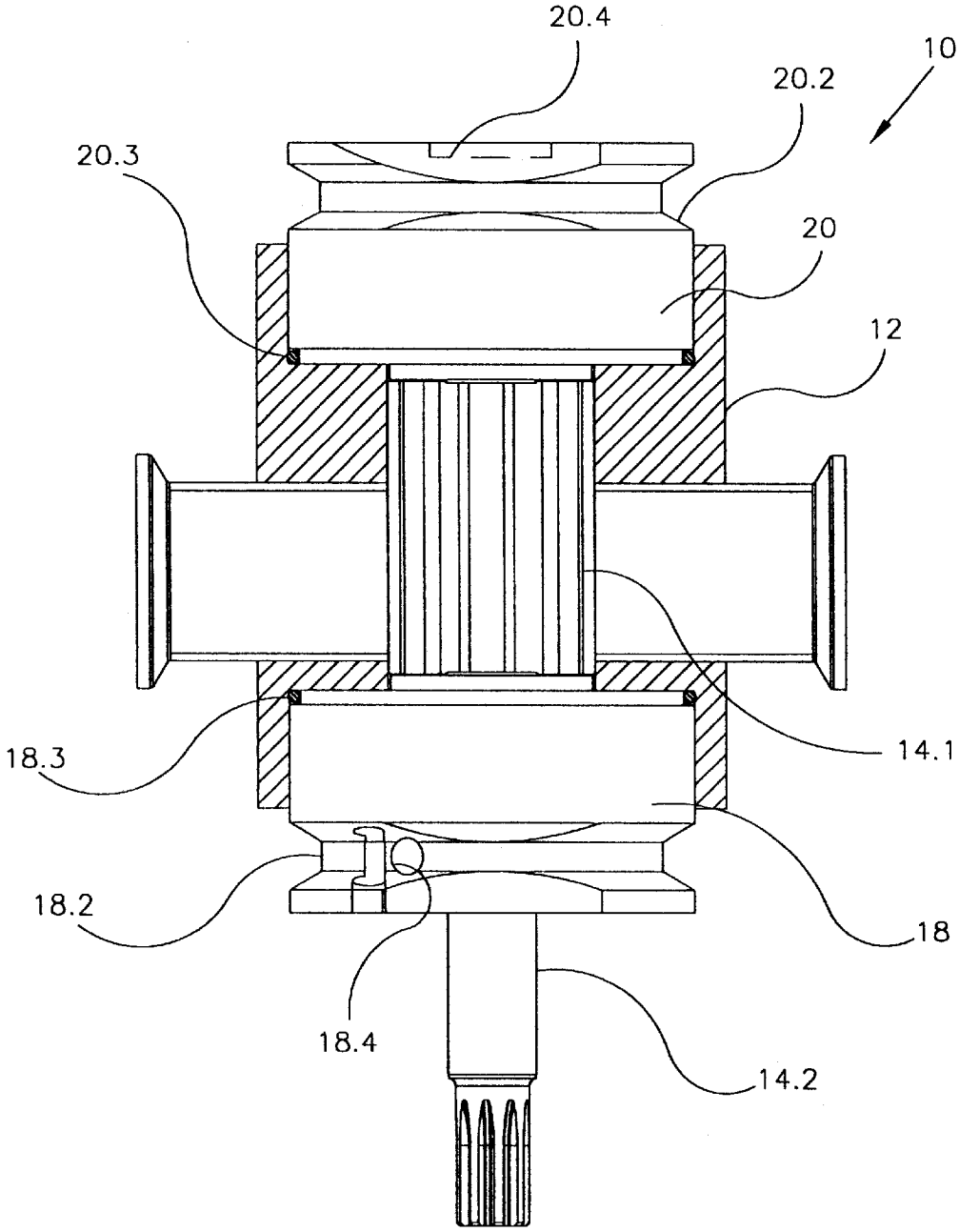
FIG. 5 Prior Art
FIG. 5 shows a partial sectional view of the pump of the prior art embodiment sold by Niagara Pump taken along the horizontal axial centerline of the pump.
Figure 5A:
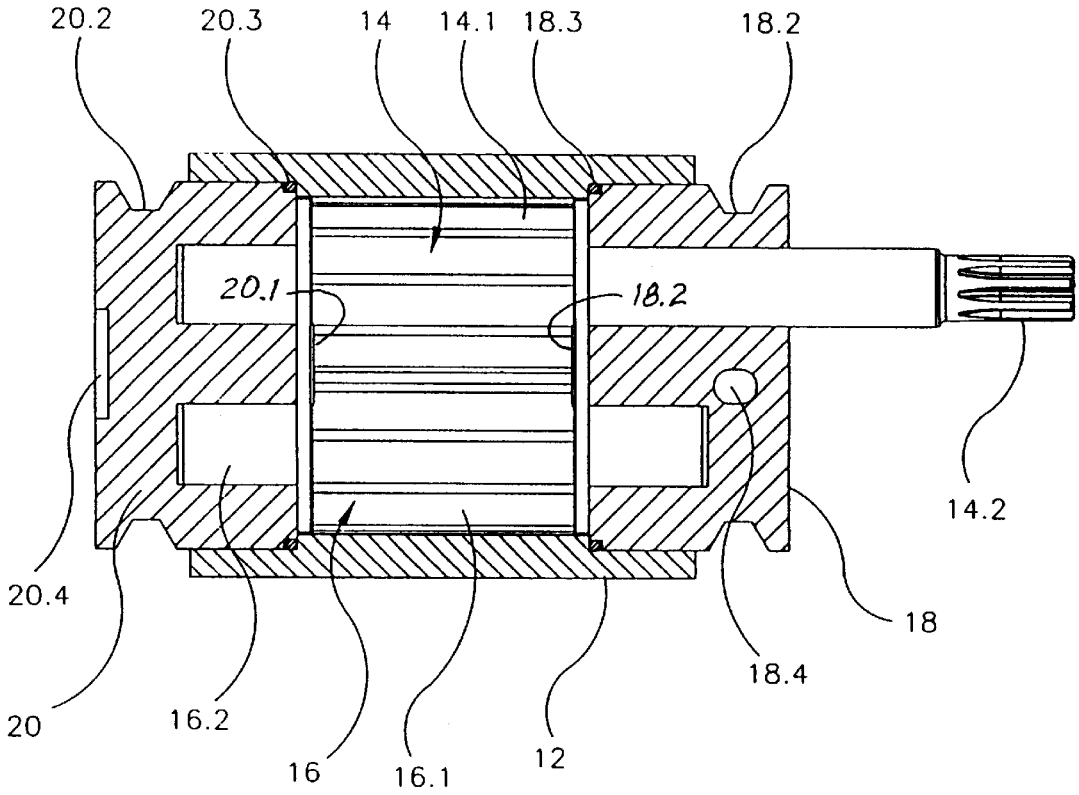
FIG. 5A Prior Art
FIG. 5A is a view similar to FIG. 5, but taken along the vertical centerline of the pump.
Figure 6:
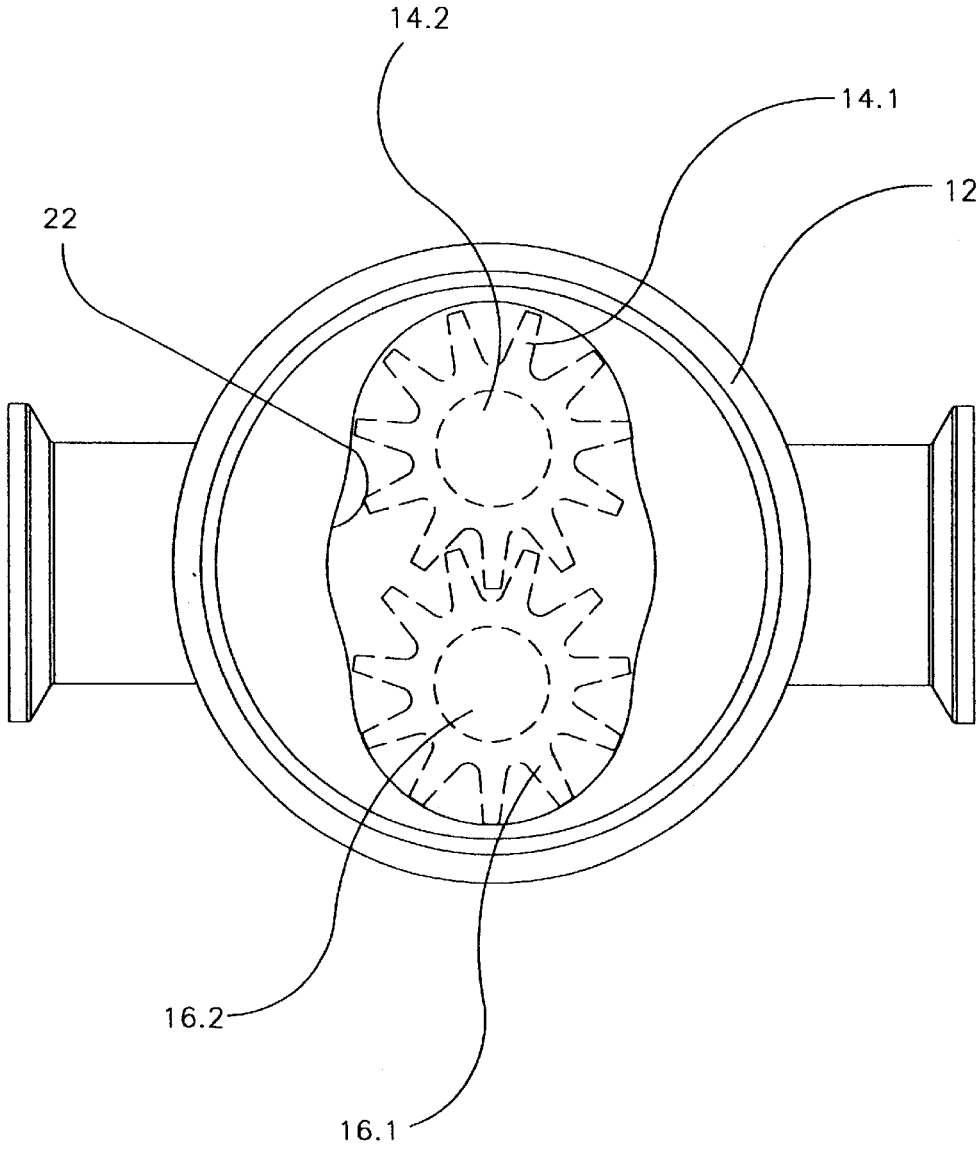
FIG. 6 Prior Art
FIG. 6 shows an end view of the pump body of the pump of the prior art embodiment sold by Niagara Pump, the drive and idler gears being shown in phantom lines
Figure 8:
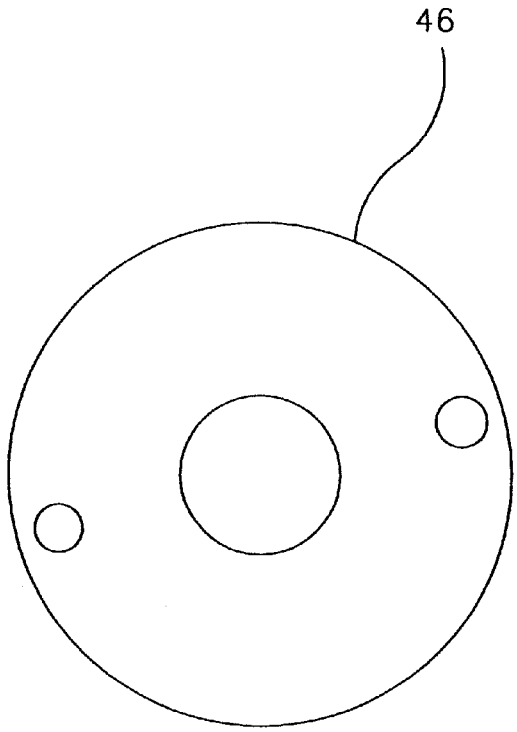
FIG. 8 Prior Art
FIG. 8 shows the pump drive gear shaft seal backer disc for the pump of the prior art embodiment sold by Niagara Pump.
Figures 9, 9A, 9B:
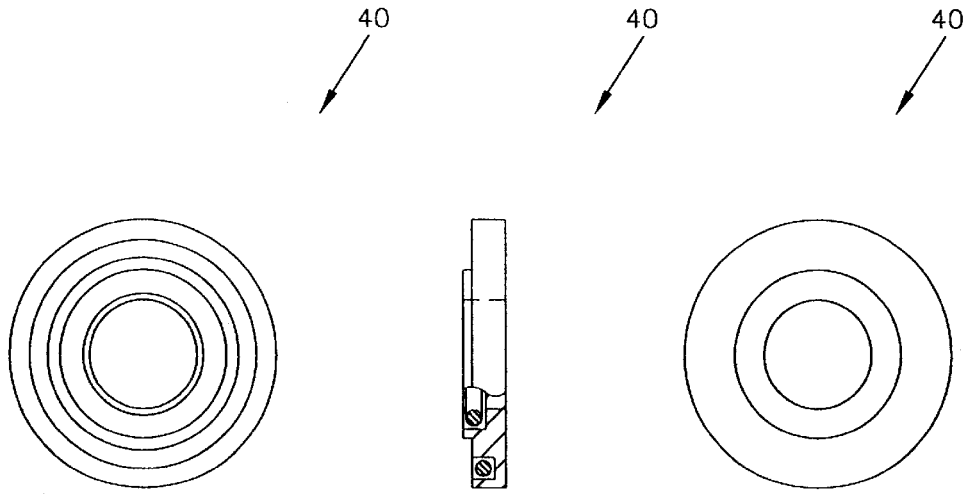
FIG. 9A Prior Art
FIG. 9 Prior Art
FIG. 9B Prior Art
FIGS. 9 to 9B show the O-ring seal housing for the pump drive gear shaft seal backer disc for the pump of the prior art embodiment sold by Niagara Pump.

In the disclosed commercial prior art gear pump disclosed in FIGS. 1–9B, the bearing block to pump body seal is contained in a gland formed on two sides by the bottom of the circular end body cavity and the circumference of the body wall, and on two sides by a step cut circumferentially into the round circular end body of the bearing block on the end abutting the gear cavity bore of the pump (See FIGS. 5 and 5A). This arrangement brings the sealing ring very close to the ends of the pump gear cavity bore, thus minimizing pumpage trap areas and reducing the areas of the pump to be cleaned. However, the flat mating faces of the pump body and bearing blocks are wetted by the pumped liquid and can represent an area of reduced or minimal fluid flow or motion, thus constituting a trap zone subject to bacterial or other contamination. This bearing block to body seal arrangement of the pump is substantially improved in the novel pump design herein disclosed.

In the disclosed commercial prior art gear pump disclosed in FIGS. 1–9B, the bearing block to pump body seal is contained in a gland formed on two sides by the bottom of the circular end body cavity and the circumference of the body wall, and on two sides by a step cut circumferentially into the round circular end body of the bearing block on the end abutting the gear cavity of the pump (See FIGS. 5 and 5A). This arrangement brings the sealing ring very close to the ends of the pump gear cavity, thus minimizing pumpage trap areas and reducing the areas of the pump to be cleaned. However, the flat mating faces of the pump body and bearing blocks are wetted by the pumped liquid and can represent an area of reduced or minimal fluid flow or motion, thus constituting a trap zone subject to bacterial or other contamination. This bearing block to body seal arrangement of the pump is substantially improved in the novel pump design herein disclosed.

In the gear pump of the present invention, the seals between the bearing blocks and pump body are uniquely positioned, with important benefits resulting. The non-drive end bearing block 106 is sealed to the pump housing by a seal ring 126 (typically an O-ring), which is identical in size and function and relative location to the seal ring 124 (FIG.

17) at the drive end of the pump body. This positioning of each seal ring is also shown in side view in FIG. 12. As can be seen, this repositioning eliminates the seal gland cut on the round circumference of the bearing blocks and instead causes the two sides of the seal gland to be placed at the end of the gear cavity bore. The other two sides of the repositioned seal gland are formed by the flat flange face of the bearing block and by the oval shaped pilot portion of the block which inserts slightly into the gear cavity bore of the pump. With this arrangement the insertion of a bearing block into the pump novelly results in a seal at the end of the gear cavity bore, thus eliminating the movement of pumped liquid to the area between the two circular faces of the bearing blocks, thus significantly improving the sanitary design of the invention. It is important to note that the seal cannot be over compressed in its gland because the flat face to face mating of the bearing block to housing defines the size of the gland.

The novel positioning of the seals 124, 126 between the bearing blocks 102 and 106 and pump body 104 confers a fundamental advantage of reducing the square area of engagement of the seal. This area reduction of the seal is a direct result of the reduced length of the seal gland allowed with the new seal position. Because the seal area goes down, the square area of flange engagement between each bearing face and the pump body goes up.

By way of further illustration of this square area relationship, in a particular embodiment of the pump of the present invention, the square area of the seal is reduced by nearly 16% with the repositioned seal location. This relative relationship holds true with any size pump of the disclosed construction geometry because the effective seal length is reduced as a result of the disclosed geometry.

The novel merits of maximizing bearing block to pump body engagement area by uniquely reducing the seal engagement area have been discussed in terms of precision and durability of assembly, prevention of bearing block distortion including from cold flow, and the sanitary advantages of the reduced seal area design have also been explained. In addition to these novel benefits, several additional points of merit will be detailed.

In the commercial prior art gear pump herein disclosed, the gear cavity bore seal ring is located circumferentially on the leading or inserted end of the bearing block. Thus, with the start of insertion of the round block into the round pump body end structure, the seal ring makes immediate contact with the two surfaces. Thus, the seal ring is forced to move across the distance of bearing insertion. Because of the compressible or close tolerance nature of such a seal arrangement, and because such assembly is generally done for sanitary reasons with the surfaces in a dry and clean condition and free of lubricants, the seal element is prone to binding or sticking against the inside wall of the pump, making bearing insertion and completion of pump assembly difficult. This seal arrangement also can allow the seal ring, typically an O-ring, to become rolled or cut or distorted or unseated from its gland as a function of insertion resulting in seal failure or pump misassembly, and pump leakage.

In the pump of the present invention, the novel bearing to body seal arrangement described and illustrated eliminates the mechanical problems of bearing to body assembly as found in the prior art. The bearing block, with seal ring fitted onto the gear cavity bore pilot portion or inboard end 102.4 or 106.4, fits freely into the pump body with essentially no seal to body contact until the bearing reaches its fully inserted and seated position. In fact, the non-drive end bearing block, as a first step in complete pump re-assembly, can be freely rotated in the body until the pilot is aligned with the gear cavity bore 104.1 at which time correct insertion occurs with a clearly audible click and a perceptible seating feel. This confers great advantages of reliability of correct assembly of the pump, free of seal wear or damage. In contrast, with the prior art gear pump detailed herein the seal ring can readily contact the inside diameter of the pump body. This makes the bearing block difficult to rotate to achieve pilot alignment and the rotation of the block can unseat or damage the seal element.

In the case of pump disassembly, the pump of the present invention confers important and novel advantages. By way of comparison, in the pump of the prior art detailed in this specification, withdrawal of the bearing block from the pump body is difficult because of the circumferential seal of the block. As the block is withdrawn, an internal vacuum is often created because of the piston-like effect of the liquid enhanced seal of the block circumference to the inside diameter of the pump body. This vacuum frequently can remain and increase until the block is essentially completely free from the body bore. This troublesome phenomenon is very prominent and discernable when the liquid being pumped is of an elevated viscosity, and is notable even at a few hundred centipoise.

In contrast, in the pump of the present invention, the location of the gear cavity bore to bearing block seals at the ends of the cavity bore result in essentially immediate seal release as the block is withdrawn from the pump body bore. This in combination with the elimination of a close tolerance circumferential seal makes bearing block removal from the pump comparatively easy, regardless of the viscosity of the pumpage.

Still another advantage of the novel bearing to body seal arrangement is that the assembly mating force required to correctly compress the seal ring 124, 126 and seat the bearing block faces 102.1, 106.1 to the pump body faces is minimized by the reduced square area of the seal elements. This has inherent advantages in terms of the manual effort required to achieve proper pump assembly force, and the applied force can further reduce bearing block mechanical distortions as previously explained.

Still another important and novel advantage of the preferred disclosed method of positioning of the seals between the bearing blocks and pump body gear cavity bore concerns leakage of pumped liquid. It will be understood that as a differential pressure is created between the infeed and discharge side of the pump as a result of pumping action, a slight leakage occurs circumferentially across the boundary space between the bearing block in the pump bore and the wall of the pump body. It is clear that the longer the bearing inserted into the pump gear cavity bore, the greater the area of potential leakage becomes. Thus, by placing the end to end seals for the pump at each periphery of the gear cavity bore and minimizing the extent to which the bearing block enters into the gear cavity bore, essentially all or nearly all of this potential leakage pathway is sealed off from fluid contact, thus eliminating this leakage pathway. This novel arrangement thus serves to greatly improve the side to side "tightness" of the pump of the present invention and substantially improves its efficiency by reducing the "slip" of the pump. The preferred pump's ability to accurately meter flow or dose liquid volumes with high repeatability is also enhanced by this unique and novel method. It should also be understood that the preferred seal method eliminates the face to face leakage pathway present with the peripheral seal ring method used in the disclosed prior art gear pump.

It should be noted that it is known and possible to seal the bearing block to the gear cavity bore using a circumferential gland and seal ring on the pilot portion of the bearing block that actually inserts into the gear bore as illustrated in FIGS. 5 and 5A. This would have the effect of reducing the net seal square area to zero relative to the square area of the bearing block to pump body engagement. However, this method presents many undesirable characteristics. Among these the foremost is the requirement that to preserve mechanical strength the insertion pilot into the gear cavity bore must become relatively longer, thus impairing the unique thermal performance of the pump which is described further on. Also, the problems of seal cutting, distortion, misposition and sticking or binding previously discussed are inherent in a seal in this location as well. Further, the gear to bearing block contact face must be as close to the seal ring gland as possible in order to preserve sanitary merit for the circumferential seal placement akin to the preferred method. This, in turn, reduces this area to a thin and relatively fragile structure more subject to wear and damage over the life of the pump.

Still another novel attribute of the design of the bearing blocks and housing of the preferred embodiment concerns the thermal characteristics of the pump. These thermal characteristics are not obvious by observation and can be properly quantified only by empirical testing. As previously noted, the bearing blocks enter into the gear cavity bore only to sufficient degree to provide the necessary purchase for the seal ring and to form two sides of the gland for the seal element, and to sufficient depth to provide adequate strength for precise and definite coaxial alignment of the gears within the gear cavity bore. Thus, when the longest gears usable in a given gear cavity bore length pump body are fitted, the portion of the bearing block extending into the gear cavity bore represents no more than twelve and one half (12.5) percent of the end to end length of the block in the illustrated design. This arrangement can be seen in FIG. 12. It can also be seen that the pilot portions of the bearing blocks enter into the gear cavity bore for a distance that is approximately equivalent to the diameter of the bearing to body seal element for the longest gears. Under this arrangement, when the temperature of the assembled pump is increased, the bearing blocks increase in face to face dimension. Because most of the block extends outward from the flat face engagement surfaces and because only a small portion of the block extends into the gear cavity bore, the dimensional increase of the block with increasing temperature is predominantly outward rather than inward toward the gear faces. Thus, novelly, the critical non-contacting close tolerance dimension between the face of each bearing block and the adjoining gear face is maintained over an extended temperature range, even when bearing materials having a comparatively high thermal coefficient of expansion are used. For example, in one embodiment of the present invention where glass filled Teflon bearing blocks are used, working tolerances can be maintained without face to face contact over a useful temperature range of at least 270° F. This can be compared to a commercially available gear pump of essentially equivalent displacement with a housing of the same material where "hockey puck" glass filled Teflon bearings are sandwiched into a housing with rigid end structures (for example, a Chemsteel pump manufactured by Oberdorfer Pump Company of Syracuse, N.Y.). In this design the useful temperature range does not exceed 140° F. before the pump becomes bound up or locked by contact of the gear faces with the bearing faces.

Figure 23A:
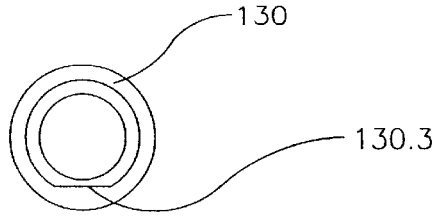
FIGS. 23 and 23A show side and end views, respectively, of the shaft seal cartridge of this invention.
Figure 23:
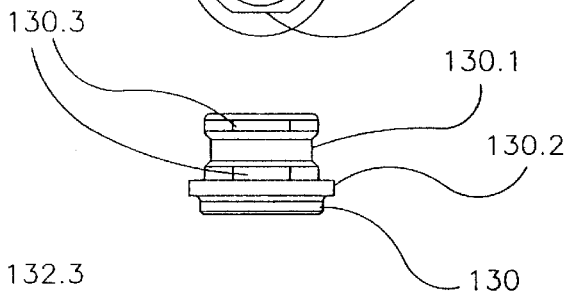
Figure 24A:
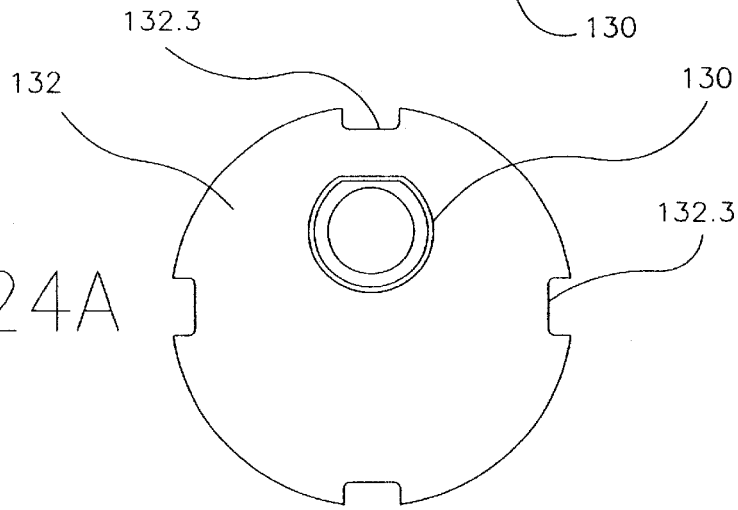
FIG. 24A is a view of the drive end clamp plate with the shaft seal cartridge assembled therein.

Numerous unique and novel aspects of the preferred embodiment of the present invention concern the shaft seal fitted to the drive gear shaft 108.1. The drive gear shaft seal assembly is pictured in FIG. 12, in FIG. 17 in exploded view, and further details are shown in FIGS. 23–23B.

The shaft seal assembly of the preferred embodiment constitutes a single cartridge assembly 112, FIG. 12. This assembly includes an element which may be termed the seal can, seal housing, seal an assembly, seal cartridge or seal gland 130. It is particularly and uniquely designed to have a circumferential finger pull groove or grip 130.1 for the purpose of making simple manual removal and installation possible. As noted with the similar geometry found on the bearing blocks, numerous alternative shapes are possible to accomplish this objective.

The shaft seal cartridge is uniquely retained in sealed position and by the drive end clamp plate 132 as shown in FIGS. 12, 13, 17, 24 and 24A, also termed the shaft seal retainer plate, the drive shaft end plate, or the drive gear shaft seal plate. Retention and sealing is novelly achieved by clamping the sealing flange 130.2 of the seal assembly between the retainer plate 132 and the recess provided in the face of the drive end bearing block 102, as best shown in FIG. 12. The recess carries a static face seal gland, typically for an O-ring 134, providing sealing of the stationary seal assembly housing 130 to the bearing block 102 via compression of the seal 134 as a function of pump assembly.

It is important to understand that the unique method by which the dynamic drive gear shaft seal cartridge is retained in and sealed to the pump assembly is of high integrity in that it is positively captured in such a way that it assures definitive and correct and precise dimensional positioning of the seal element. This results in an assembled seal arrangement which cannot back off or loosen with resultant leakage. This also results in a dynamic shaft seal which can be readily assembled without significant possibility of error or damage.

The seal assembly is uniquely designed to maintain the use of the same outside diameter housing and the same seal ring static face seal while allowing the internal seal structure to be varied to include numerous shaft seal methods including dynamic O-ring 136 (as shown in FIG. 17), Vee ring, U-cup, internal sanitary mechanical, and external sanitary mechanical. Only the length of the seal gland or housing or can need vary with the use of the various types.

Another novel aspect of the seal assembly is the provision by which rotation of the seal housing relative to the bearing block is prevented. The seal housing experiences a rotational force when the pump drive gear shaft 108.1 is turning. This is due to frictional engagement between the shaft, the shaft seal element 136 and the seal housing 130. Rotation is prevented by use of a flat 130.3 on the sealing flange of the seal cartridge which matches a similar flat 132.1 on the shaft hole 132.2 on the seal clamp plate 132. The result is two generally "D" shaped elements, one "male" and one "female" which lock together thus preventing rotation of the seal housing 130. The mating is relatively loose and easy to achieve and, because both elements freely rotate relative to the bearing block, ease of assembly is not impaired in any way. In addition, the seal clamp plate 132 is provided with notches 132.3 which permit the plate to pass over the pin 142 during assembly.

As previously noted, it is an objective of the invention to provide a sanitary design gear pump which is simple and easy to disassemble, clean and reassemble. A significant aspect of this objective is the requirement to be able to readily mount the pump to its drive and to readily dismount the pump from its drive. Thus, the pump mount of the present invention, which is indicated generally at 138, is unique and novel in its important features. The mount is best illustrated in FIGS. 13–16A.

Figure 16:
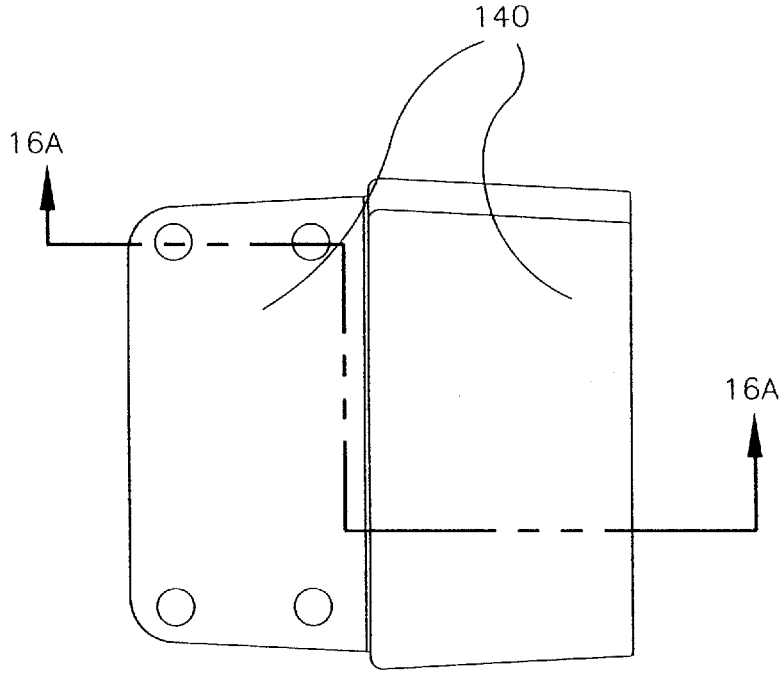
FIG. 16 shows a top view of the pump mount of the preferred embodiment of this invention.
Figure 16A:
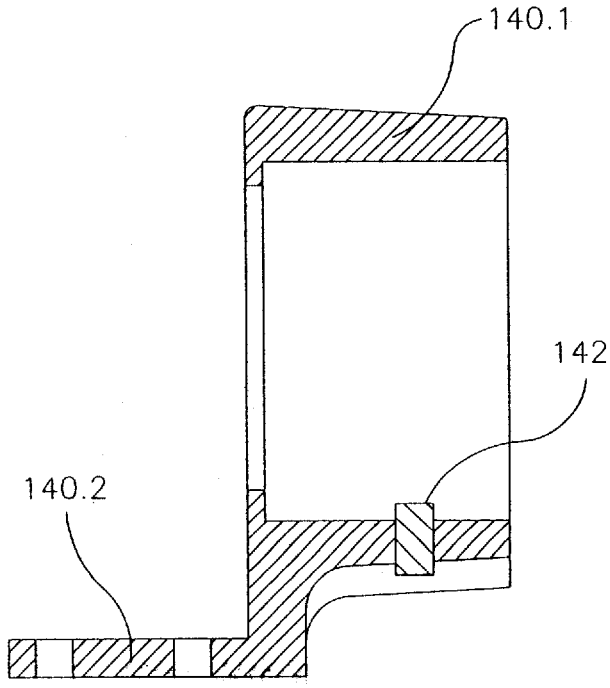
FIG. 16A shows a side sectional view of the pump mount of this invention, this view being taken generally along the line 16A—16A in FIG. 16.

The pump mount 138 consists of a casting 140 or the like having in part a cylinder portion 140.1 designed to receive the pump body and drive end bearing structure. The cylindrical portion of the pump mount supports the pump drive shaft end bearing block 102 and pump body 104 circumferentially, such that when assembled, the bearing block is inserted completely within the mount as is a substantial portion of the pump body. As shown in FIG. 16A, the casting 140 is designed to provide a foot 140.2 which is reversed away from the pump mount receiver 140.1, thus assuring that the pump, when mounted, is overhung away from the foot. This novelly assures that the inflow and outflow pump ports 104.4 and 104.5, respectively, are unobstructed by the mount thus providing free access to the pump infeed and outfeed ports, regardless of their rotational orientation.

Figure 13:
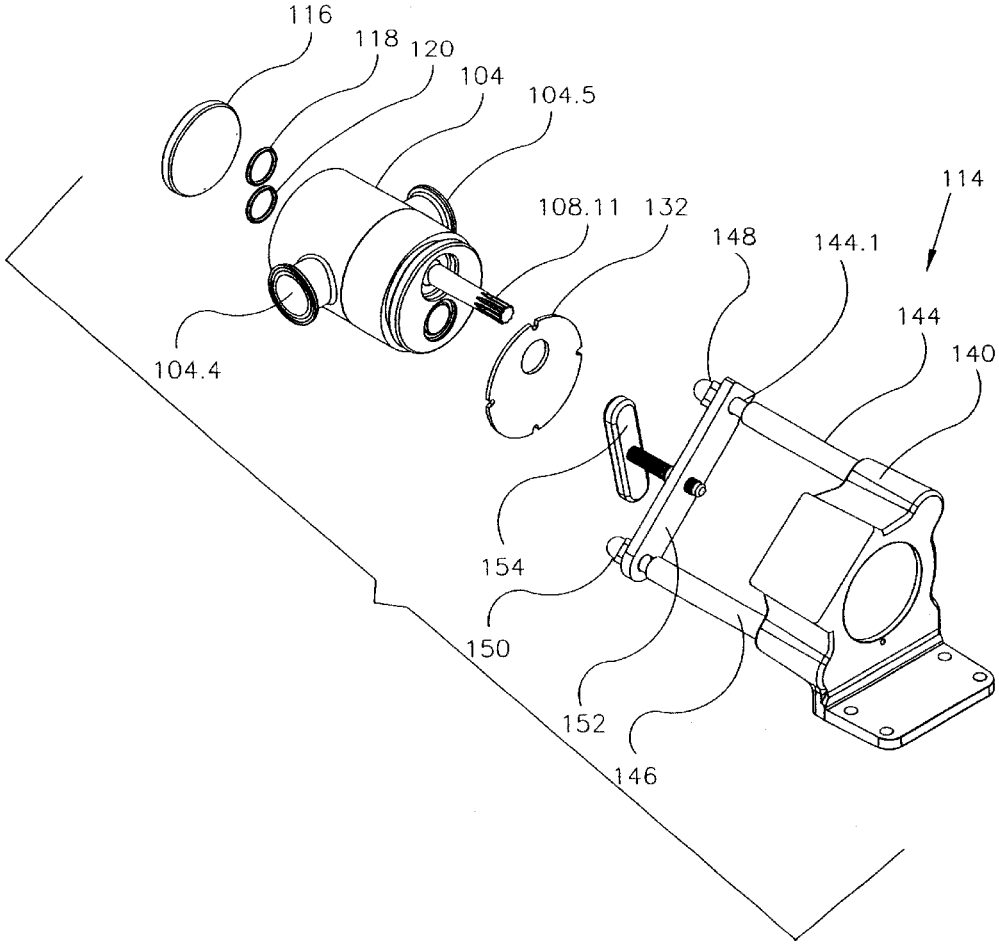
FIG. 13 shows an exploded perspective view of the pump assembly of the preferred embodiment of this invention and the pump mount and assembly hardware.
Figure 14:
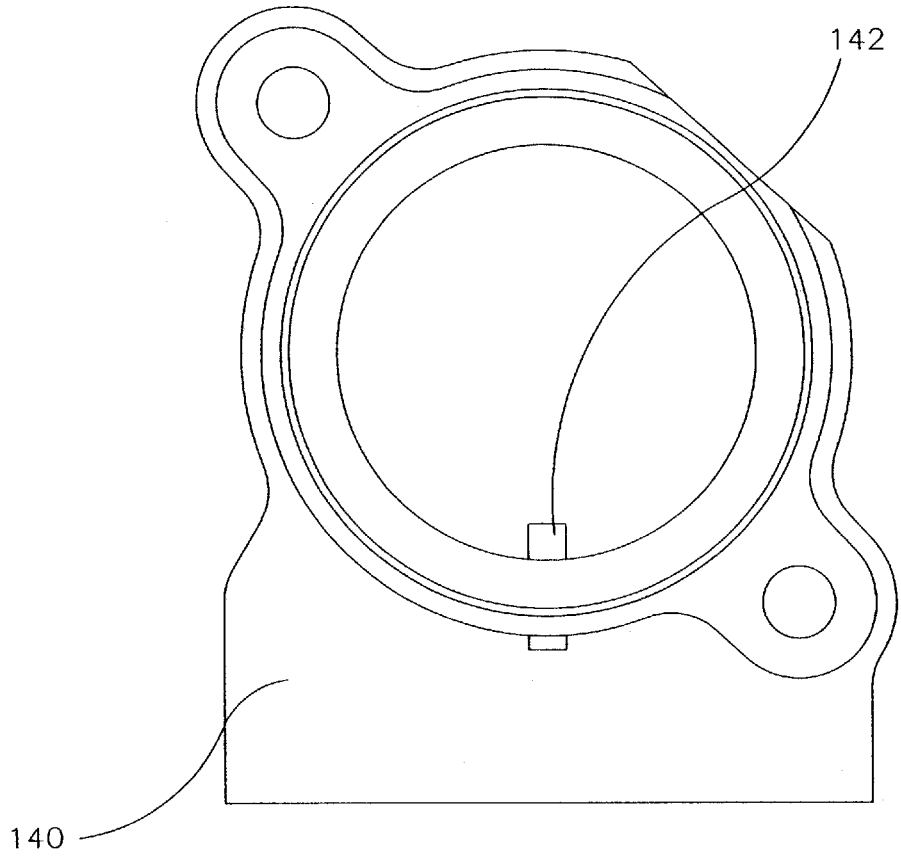
FIG. 14 shows a non-drive end view of the pump mount of the pump assembly of the preferred embodiment of this invention, the assembly hardware being omitted.
Figure 15A:
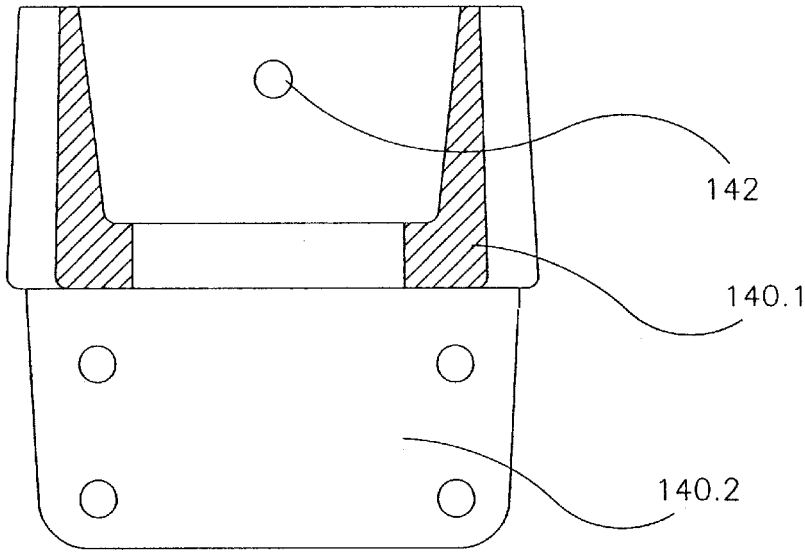
FIG. 15A shows a top horizontal centerline sectional view of the pump mount of this invention, this view being taken generally along the lines 15A—15A in FIG. 15.
Figure 15:
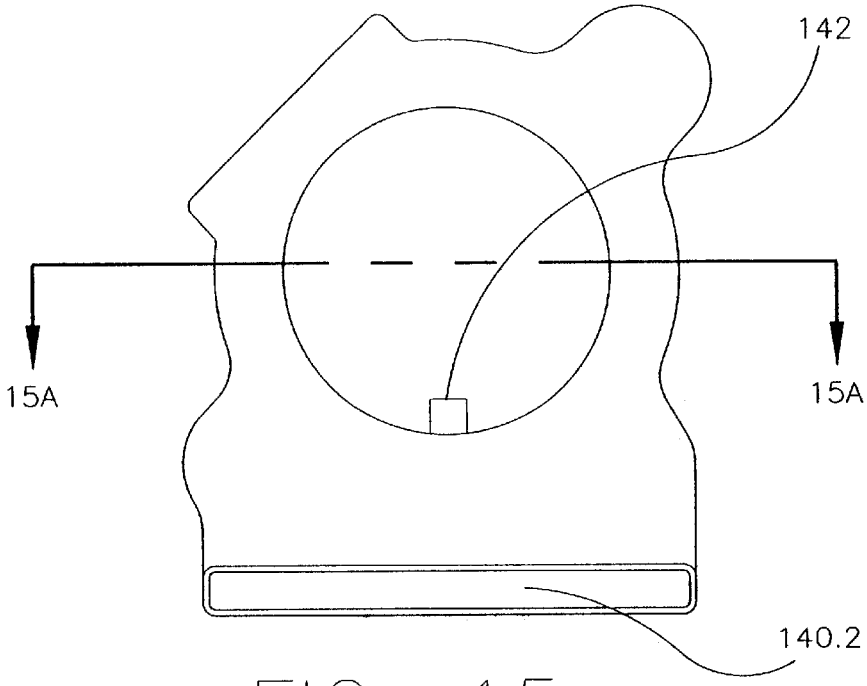
FIG. 15 shows a drive end view of the pump mount of the pump of the preferred embodiment of this invention.
Figure 18:
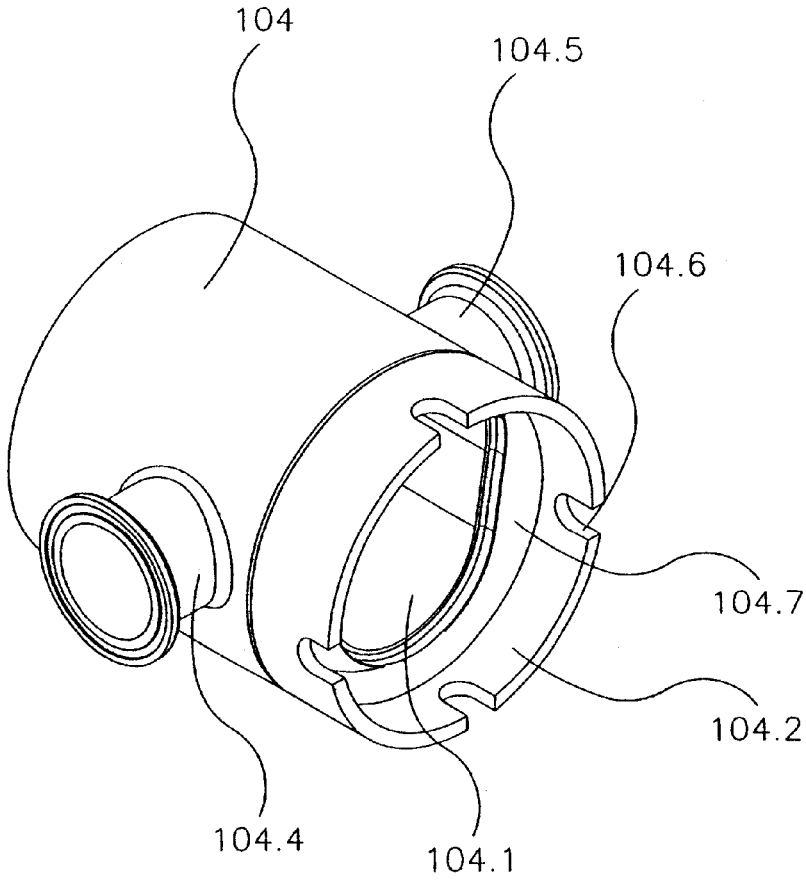
FIG. 18 shows a perspective view of the pump body of the preferred embodiment of this invention showing the bearing block engagement face and the pump mount positioning slots.

The pump mount is also novel in the means by which the pump is oriented and secured rotationally within the mount. As shown in FIGS. 13, 17 and 18, the pump body 104 is provided with four locator slots 104.6 or channels at ninety degree intervals on the circumference of the drive end of the pump housing 104. Each slot 104.6 is cut completely through the wall of the housing and is provided with a lead-in bevel or taper guide as can best be seen from FIG. 19A. The described slots engage with a robust mating pin 142 located well within and at the bottom of the bore of the pump mount (see FIGS. 12, 14, and 15A). This pin and slot design allows the pump to be securely and precisely and repeatably placed into its mount with the pump ports orientable to any of four possible locations at ninety degree intervals, and provides the mechanical strength to prevent the pump from rotating in its mount as a result of rotational or tangential forces applied to it.

Figure 10:
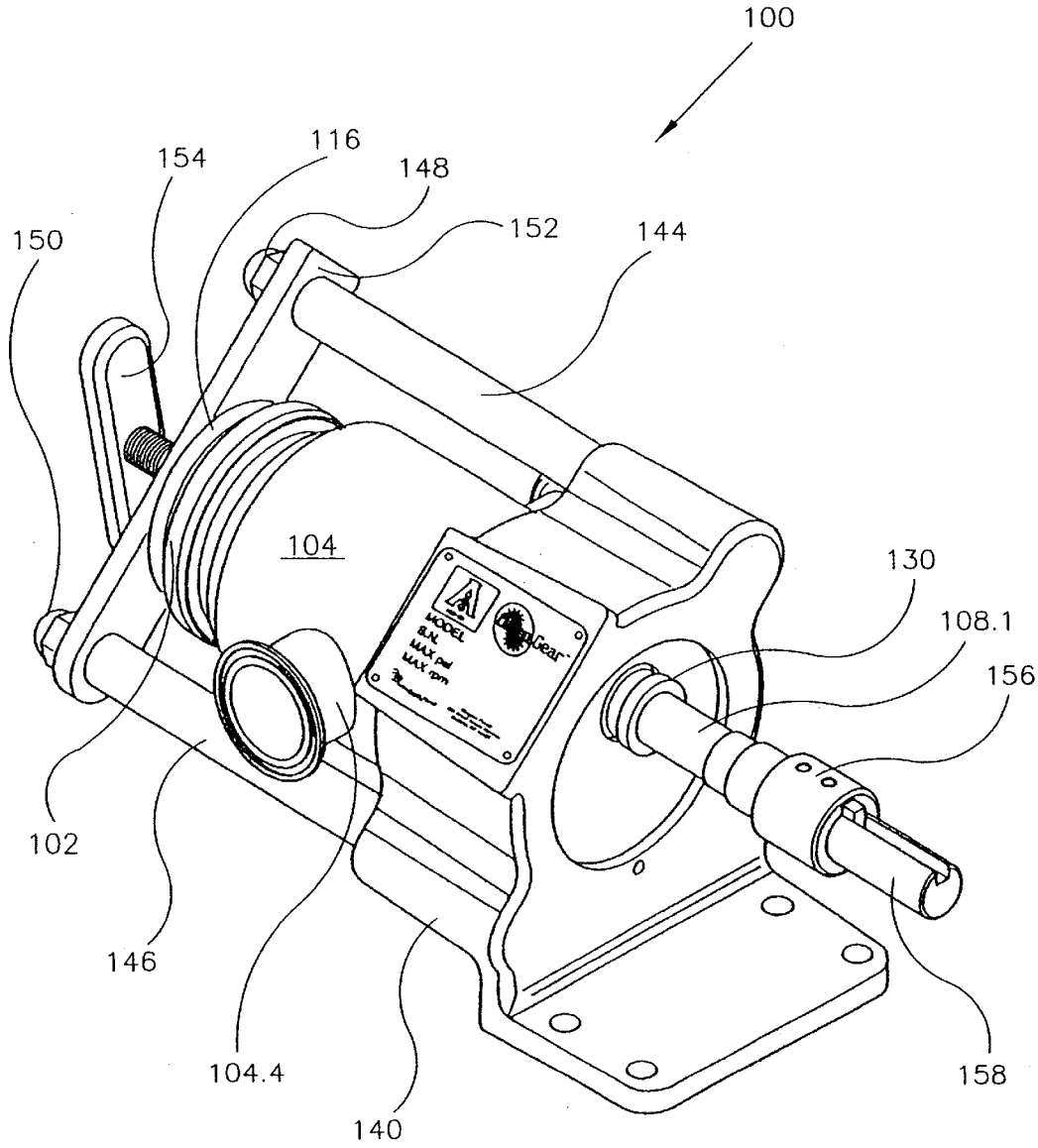
FIG. 10 shows a perspective view of the fully assembled pump of the preferred embodiment of this invention.
Figure 11:
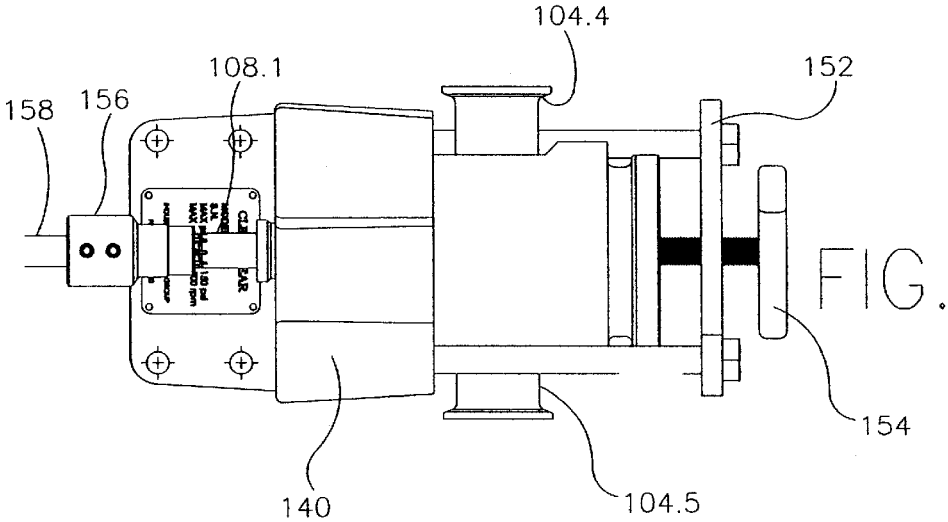
FIGS. 11, 11A and 11B show a top view, a side view and a drive end view, respectively, of the fully assembled pump of the preferred embodiment of this invention.
Figure 11A:
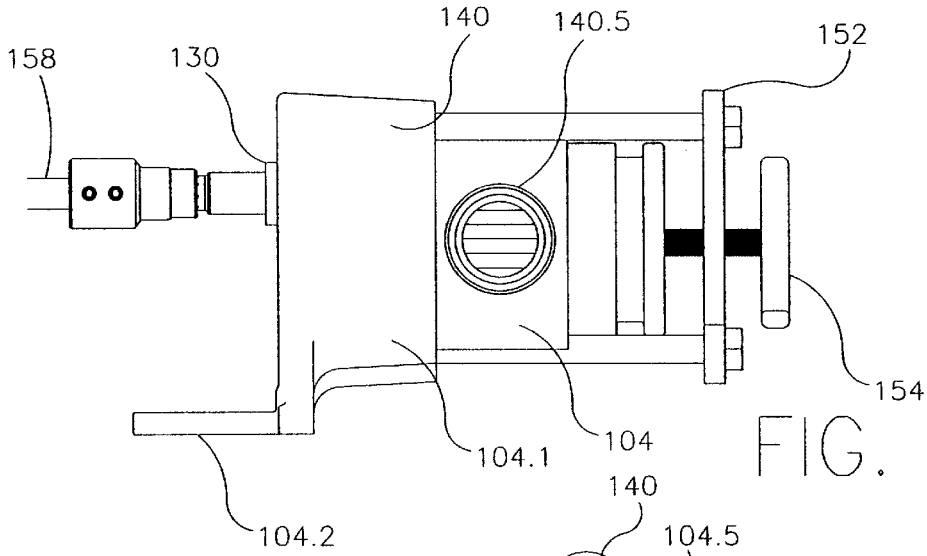
Figure 11B:
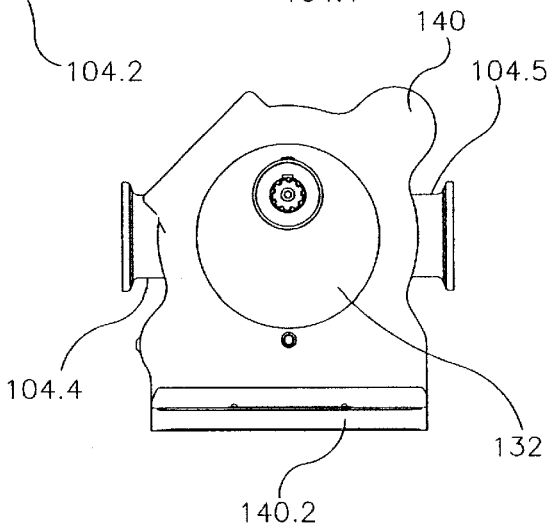

The pump mount is novelly provided with integrated binding tie rods 144, 146 as shown in FIGS. 10 and 13. Each rod 144, 146 has a reduced diameter portion, such as 144.1, and an adjacent enlarged bolt 148, 150, respectively. A captured cross bar 152, also termed a bar clamp, is pivotally mounted on the reduced diameter portion of tie rod 146 by bolt 150 such that it can pivot across the face of the pump and engage the reduced diameter portion 144.1 of the rod 144. The cross bar 152 carries a hand turned binder screw 154 at its center point, such that the screw member 154 can be tightened down upon the center 116.1 of a non-drive end clamp plate or end seal plate 116. As can be appreciated from FIG. 12, tightening screw 154 compresses the stacked together pump components, sealing each element to the next, and locating the pump securely within the mount 140. Thus, the pump mount in combination with the pump itself uniquely provides for a sanitary gear pump having only a single hand operated fastener required for complete pump assembly and mounting. Thus a true no-tool sanitary gear pump is embodied. It is important to understand that this clamping arrangement of the preferred embodiment varies from that used in the prior art in that the clamping rods in the preferred embodiment are attached to the pump mount rather than to the pump drive end bearing block. Thus these parts of the design uniquely remain mounted and captured when the pump is removed from the mount. This enhances operator convenience and eliminates the problem of lost or mis-assembled parts.

Still another unique and important feature of the pump mount and binding hardware arrangement is that the binding force applied to the pump is coaxially centered thus applying binding force to the complete structure of the pump in a way that is also balanced and centered through the front to back axis of the pump. This method differs from the assembly force method and load distribution in the prior art pump herein described in that the compression force of the pump assembly method of the pump of the present invention acts upon the entire pump component stack with the binder posts anchored to the pump mount rather than to the drive end bearing block. Thus, the binding force is circumferentially distributed equally about the periphery of the pump at the drive end and centered coaxially at the non-drive end. This is not the case with prior art methods. This force pattern results in a highly equalized and properly distributed compression of all of the seal elements in the pump stack, thus assuring proper seal and parts alignment and compression.

Still another unique and novel feature of the pump mount is that, once aligned to a particular pump drive, the pump can be repeatedly installed and removed from the mount without any change in the alignment of the pump drive gear shaft to the pump drive shaft. This ability is crucial to the design in that, by intended use and application, the pump will be frequently removed from the mount for cleaning and sanitation purposes. It is also a unique and novel feature of the pump mount that any particular pump of a given model can be interchanged with any other of the same model on the same mount, thus enhancing application convenience where multiple pumps are utilized.

As can be seen in FIG. 13, the drive gear shaft is preferably designed with a splined end 108.11. Also as visible in FIG. 12, the male spline is fitted to a female spline coupling 156 which may, in turn, be fitted with a keyed stub shaft 158 to allow adaptation to the female end of a flexible drive coupling which is permanently fitted to the drive element shaft. This spline shaft arrangement, in combination with the already described pump mount, provides for still another novel feature of the present invention. Specifically, the pump mount allows removal of the pump from its mount without tools and the spline design allows the drive gear shaft to be separated from the pump drive without tools and further allows the pump to be disassembled completely with the gear drive shaft able to pass through the drive end bearing block without impediment and without the need or requirement to remove any sort of drive coupling from the drive gear shaft.

Because the pump of the present invention is particularly designed to allow ease of disassembly and re-assembly, the diameters of the shafts 108.1 and 110.1 of the drive gear assembly 108 and the driven gear assembly 110 (also termed the idler gear) are uniquely designed to be of different diameters. This provision precludes the possibility of pump assembly with the gears in the incorrect location thus facilitating correct pump assembly. Further, and also novelly, the length of the shaft bores of the drive end and driven end bearing blocks are deliberately different, assuring that the gears must be correctly oriented to allow successful pump re-assembly. Thus, with these two provisions, it is not possible to incorrectly assemble the pump.

The preferred embodiment of the pump of the present invention provides two different and novel means of reconfiguration to effect a change in pump displacement.

As with conventional gear pumps, changing the length of the gear in a given pump bore geometry, where the diameter of the gear is therefore held constant, alters the volumetric displacement per revolution of the pump. As the gear grows longer, the displacement increases. As it grows shorter, displacement goes down.

In the preferred embodiment, it can be shown that the pump ports 104.4, 104.5 are placed on the pump housing 104 in a highly asymmetrical way. As shown, the ports are relatively close to the non-drive end of the pump body. Thus, novelly, to fit shorter length gears, another pump housing can be used which is identical to the larger one save for its overall length. Uniquely, the geometry and dimensions of the non-drive end of the housing do not change, nor do the dimensions of the non-drive end bearing block. Thus, because only the gear length changes along with the length of the pump body, the ease and economy of reducing pump displacement in this manner is particularly noteworthy. It is particularly important to recall that with the pump ports offset as they are, the gear train can move substantially forward within the pump housing as the gear length decreases, thus avoiding any issues of hydraulic flow or motion within the pump. Using this novel method it is possible to offer a volumetric flow range varying over a 6:1 ratio using only three pump bodies. It is also crucial to understand that this method preserves the pump body to bearing block arrangement where very little of the bearing body enters the pump cavity, thus preserving the unique and meritorious thermal characteristics of the pump.

The second means of reconfiguring the preferred embodiment pump to effect a change in pump displacement is also novel. In this second method, the drive end bearing block and the two shafted gears are replaced with alternate sizes. In the case of gears which are shorter than the gear cavity bore of the pump body, which remains unchanged, the replacement bearing block is longer in that portion which enters into the gear cavity bore of the pump body. This method is clearly illustrated with regard to the bearing blocks in FIGS. 21–21B which shows three sizes, one (FIG. 21) for the largest gear (FIG. 17C) fittable to the gear cavity bore of the particular pump body, as well as two others offering reduced displacement.

Figure 21:
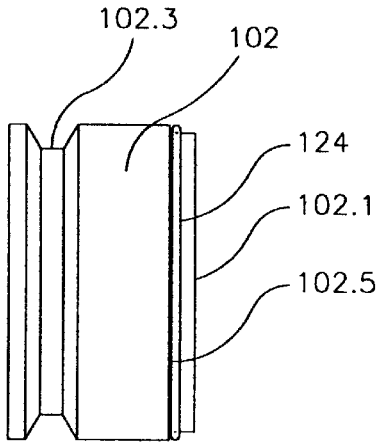
FIGS. 21, 21A and 21B show side views of the drive end bearing blocks for three gear sizes as shown in FIGS. 17A–17C for the pump of the preferred embodiment of this invention.
Figure 21A:
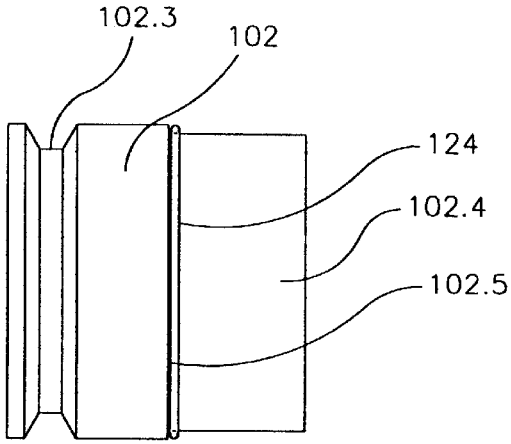
Figure 21B:
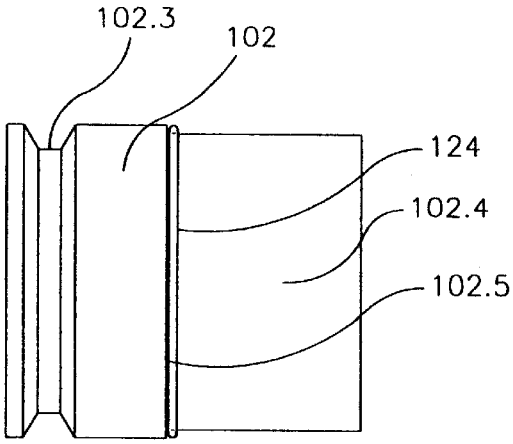

In FIGS. 17A–C, three corresponding gear sizes, varying only in length, are shown, the longest (FIG. 17C) corresponding to the shortest bearing block in FIG. 21, the intermediate gear length (FIG. 17B) corresponding to the intermediate bearing size in FIG. 21A, and the shortest gear length (FIG. 17A) corresponding to the longest bearing block size in FIG. 21B. These combinations represent a volumetric flow range variable over a range of 6:1.

This second method of altering displacement is even simpler and more economical than the first, but it exacts a price in thermal performance. As one skilled in the art will understand, the longer the bearing structure the greater its absolute dimensional growth with an increase in temperature. Thus, the pump of the third embodiment, when refitted to the shortest gear-longest bearing combination, has a reduced operating temperature range before gear face to bearing block face contact occurs. However, because the bearing block on the non-drive end of the pump remains configured in a thermally favorable geometry, the operating temperature range remains substantially wider than a pump of conventional construction with shaft bearings of equivalent dimensions and of equivalent bearing material.

Still another unique aspect of the pump of the preferred embodiment concerns the shaping of the pump drive shaft. It will be understood that the pumps of the present invention are designed to allow and facilitate frequent disassembly and re-assembly for cleaning, sanitation and inspection. Because disassembly requires removal and cleaning of the drive gear shaft seal, and because shaft seals of all types are known to be vulnerable to damage and malfunction as a result of handling, particular attention has been paid to this problem in the preferred embodiment of the present invention. Specifically, as can be seen in FIG. 17, the drive shaft is shaped such that its diameter reduces prior to the spline coupling and the diameter transitions through a fifteen degree taper. This provision thus allows the seal to be placed onto the shaft with no or minimal contact with the spline drive portion of the shaft. Because the spline area 108.11 has a tendency to become nicked, ground and roughened and burred with use, and because nearly all seal types rely upon an elastomeric or hard plastic shaft to seal element, this ability to fit the seal onto the shaft without resistance from the shaft itself is fundamentally important to allow seal survival and service with frequent install/removal cycles. The shaft diameter transition then becomes equally important in its requirement to be smooth and non-abrading and hence the use of the smooth and gradual chamfer.

While a preferred form of this invention has been described above and shown in the accompanying drawings, it should be understood that applicant does not intend to be limited to the particular details described above and illustrated in the accompanying drawings, but intends to be limited only to the scope of the invention as defined by the following claims.

What is claimed is:

1. A sanitary design gear pump comprising:

a pump housing having
- a pump body bore extending from one end to the other end of the housing,
- one end portion of the pump housing being circular in cross section and being further provided with a locator slot at the drive end of the pump housing, the slot being shaped to provide a tapered guide, and
- spaced apart inlet and outlet ports extending through the circumference of the pump housing, the ports being spaced away from the end portion;

drive and idler gear assemblies including
- gear shafts and
- meshing drive and idler gears mounted between the ends of gear shafts, the gear assemblies being disposed within the pump body bore;

two gear shaft bearing blocks mounted within the pump body bore, the bearing blocks including gear shaft support bearings; and a pump mount having
- a pump housing receiving portion which is circular in cross section, and a mating pin which projects into the locator slot to select pump port orientation.

2. The sanitary design gear pump as set forth in claim 1 wherein four locator slots are located at 90° intervals at the drive end of the pump housing, each slot being shaped to provide a tapered guide, the mating pin projecting into one of the four locator slots to allow selection of pump port orientation in any of four possible locations, at ninety degree intervals of rotation.

3. The sanitary design gear pump as set forth in claim 1 wherein the shaft of the drive gear assembly is provided with splines at one end, and further characterized by the provision of a mating female spline coupling secured to a drive shaft, to allow removal of the pump from its mount without the requirement to remove any shaft to drive coupling as the spline design allows the drive gear shaft to be separated from the pump drive without tools and further allows the pump to be disassembled completely with the gear drive shaft able to pass through the drive end bearing block without impediment and without the need or requirement to remove any sort of drive coupling from the drive gear shaft.

4. A sanitary design gear pump comprising:

a pump mount having a pump housing receiving portion which is circular in cross section, and a mating pin which projects into the pump housing receiving portion;

a pump housing having spaced apart inlet and outlet ports, one end portion of the pump housing being circular in cross section and being further provided with four locator slots located at 90° intervals, each slot being shaped to provide a tapered guide, the mating pin and slots allowing selection of pump port orientation in any of four possible locations, at ninety degree intervals of rotation; and mounting structure carried by the pump mount for mounting a portion of the pump housing and the drive end bearing block within the pump housing receiving portion of the pump mount with the inlet and outlet ports spaced away from the pump mount whereby the ports are unobstructed by the pump mount.

5. The sanitary design gear pump as set forth in claim 4 wherein the pump mount has a mount foot which extends away from the pump housing receiving portion whereby the pump mount has a "Z" shaped configuration, thus allowing a fully overhung pump mount.

6. The sanitary design gear pump as set forth in claim 4 wherein said one end portion of the pump housing is the drive end, whereby the pump mount, when aligned to a pump drive, allows the removal of the pump housing from the pump mount for cleaning and replacement without any loss of pump-mount-drive alignment.

7. The sanitary design gear pump as set forth in claim 4 wherein the mounting structure includes two tie rods, a cross bar captured by one of the tie rods and which swings across to and engages with the second tie rod, a single hand operated threaded fastener.

8. The sanitary design gear pump as set forth in claim 7 wherein the two tie rods are permanently secured to the pump mount.

9. The sanitary design gear pump as set forth in claim 7 wherein the pump housing has a pump body bore extending from one end to the other end of the housing; the sanitary design gear pump further comprising drive and idler gear assemblies disposed within the pump body bore, the drive and idler gear assemblies including gear shafts and meshing drive and idler gears mounted between the ends of gear shafts; and drive and non-drive end gear shaft bearing blocks mounted within the pump body bore, which blocks constitute hand removable structural end bodies of the gear pump, the bearing blocks including gear shaft support bearings; and a seal plate applied against the outer face of the non-drive bearing block;

the single hand operated threaded fastener being tightened upon the center of the non-drive end seal plate to effect complete pump assembly, sealing and location, all without the need for or use of tools of any sort.

10. The sanitary design gear pump as set forth in claim 9 wherein the bearing blocks have cylindrical outer surfaces which are received within corresponding cylindrical surfaces of the gear cavity bore, wherein the non-drive bearing block has a circular recess concentric with its cylindrical outer surface, wherein the seal plate is circular and has a centrally located recess on its outer surface, and when assembled onto the non-drive bearing block, is centered in the recess, the parts being so arranged and constructed that the threaded fastener, when bearing against the centrally located recess, causes the application of binding force by the single threaded clamping fastener to be centered so that a truly centered and balanced coaxial assembly force is applied through the entire pump structure.

11. A sanitary design gear pump kit capable of being assembled to offer a volumetric flow range varying over a 6:1 ratio; said kit comprising:

a pump housing having a pump body bore extending from one end to the other end of the housing, the pump body bore having an oval shaped gear cavity bore, and cylindrical portions at each end of the gear cavity bore;

a driven end gear shaft bearing block adapted to be mounted within one of the cylindrical portions, and first, second and third drive end gear shaft bearing blocks adapted to be mounted within the other one of the cylindrical portions, each bearing block having a pair of gear shaft support bearings, and a pilot portion received within the central oval shaped portion, differing driven end bearing blocks having differing length pilot portions; and first, second and third drive and idler gear assemblies adapted to be disposed within the gear cavity bore, the drive and idler gear assemblies including gear shafts carried by the gear shaft support bearings, and meshing drive and idler gears mounted between the ends of gear shafts, the gears being received within the central oval shaped portion of the pump housing and between the pilot portions, the gears of the first, second and third drive and idler gear assemblies being of differing lengths;

whereby by using differing drive and idler gear assemblies and differing drive end bearing blocks the volumetric flow range of the sanitary design gear pump is variable over a range of 6:1 with a single pump body.

12. A sanitary design gear pump kit capable of being assembled to offer a volumetric flow range varying over a 6:1 ratio; said kit comprising:

a pump mount having a pump housing receiving portion;

first, second and third pump housings adapted to be received in the pump housing portion, each housing having a pump body bore extending from one end to the other end of the housing, the pump body bore having an oval shaped gear cavity bore, and cylindrical portions at each end of the gear cavity bore, the central oval shaped portion of the three pump housings being of varying lengths;

two gear shaft bearing blocks adapted to be mounted within the gear cavity bore, each bearing block having gear shaft support bearings, a cylindrical portion received within an associated cylindrical portion of the gear cavity bore, and a pilot portion received within the central oval shaped portion; and first, second and third drive and idler gear assemblies adapted to be disposed within the gear cavity bore, the drive and idler gear assemblies including gear shafts carried by the gear shaft support bearings, and meshing drive and idler gears mounted between the ends of gear shafts, the gears being received within the central oval shaped portion of the pump housing and between the pilot portions, which gears may be of a varying lengths;

whereby the volumetric flow range of the sanitary design gear pump is variable over a range of 6:1 with a single pair of gear shaft bearing blocks.

13. A sanitary design gear pump comprising:

a pump housing having a pump body bore extending completely through the housing from one end to the other, the pump body bore being subdivided into parts including a central generally oval shaped gear cavity bore portion, and a cylindrical cavity adjacent each end of the oval shaped gear cavity portion;

a gear shaft bearing block received in each cylindrical cavity, each bearing block having a pair of gear shaft support bearing holes which, for ease of sanitation, extend completely through the block; and drive and idler gear assemblies disposed within the pump body pump body bore, the drive and idler gear assemblies including gear shafts which extend through the gear shaft support bearing holes, and meshing drive and idler gears mounted between the ends of gear shafts, the drive and idler gears being received within the central generally oval shaped gear cavity portion.

14. A sanitary design gear pump comprising:

pump housing having a pump body bore extending from one end to the other end of the housing;

two spaced apart gear shaft bearing blocks mounted within the pump body bore, which blocks constitute hand removable structural end bodies of the gear pump, each of the bearing blocks including a pair of gear shaft support bearing holes which are through holes extending completely through the bearing blocks, each bearing block extending outward of the pump housing thus facilitating hand assembly and disassembly of the bearing block into and out of the pump housing; and drive and idler gear assemblies disposed within the pump body bore, the drive and idler gear assemblies including gear shafts which extend through the gear shaft support bearing holes and meshing drive and idler gears mounted between the ends of gear shafts, the drive and idler gears being received in a portion of the bore between the spaced apart bearing blocks.

15. The sanitary design gear pump as set forth in either claim 13 or 14 wherein seals are provided between the pump housing and the gear shaft bearing blocks, and at the outboard end of each gear shaft bearing hole, and wherein the materials, joints, finish, and seals of the pump, as well as all other aspects of the pump, fully comply with 3-A Sanitary Standards for Centrifugal and Positive Rotary Pumps for Milk and Milk Products, Number 0-09 formulated by International Association of Milk, Food and Environmental Sanitarians United States Public Health Service The Dairy Industry Council.

16. The sanitary design gear pump as set forth in either claim 13 or 14 wherein each of the bearing blocks has an outer face, and further characterized by structure for sealing the through holes for the purpose of preventing leakage of liquid from the inside of the pump to the outside of the pump, said structure including seal rings and a seal plate applied against and acting upon the outer face of each of the bearing blocks.

17. The sanitary design gear pump as set forth in claim 16 wherein the outer faces of the bearing blocks are provided with gear shaft seal ring glands which are sized to grip the seal rings during the pump assembly process thereby easing and simplifying pump assembly.

18. The sanitary design gear pump as set forth in either claim 13 or 14 wherein the length of the gear shaft support bearing holes in the bearing blocks are greater than the diameter of the bearing holes thereby increasing bearing area while also permitting unimpeded cleaning and inspection as required for compliance with santary standards and practices.

19. The sanitary design gear pump as set forth in claim 14 wherein the pump body bore has a central generally oval shaped gear cavity bore which receives the gears, and cylindrical portions which are circular in cross section and located at each end of the oval shaped gear cavity bore, which cylindrical portions receive a portion of the gear shaft bearing blocks, there being pump gear faces between the gear cavity bore and the cylindrical portion.

20. The sanitary design gear pump as set forth in claim 19 in which each bearing block is provided with a pilot portion which extends into the gear cavity bore, the pilot portions of the bearing blocks entering into the gear cavity bore for a distance that is approximately equivalent to the diameter of the bearing to body seal element for the longest gear.

21. The sanitary design gear pump as set forth in claim 20 wherein thermal expansion of the bearing blocks with increasing pump temperature results in dimensional increase predominantly to the portions of the block outside of the gear cavity bore, thus allowing a usable gear face to bearing face tolerance to be maintained without contact over a temperature range of at least 270°.

22. The sanitary design gear pump as set forth in claim 19 wherein each bearing block is provided with a circular flange-like face and a pilot portion adjacent the flange-like face, the flange-like face area being maximized because of gear cavity to bearing block seal placement.

23. The sanitary design gear pump as set forth in claim 22 further comprising force applying means to apply an assembly clamping force onto the bearing blocks when assembled into the pump housing, the parts being so arranged and constructed that the possibility during pump assembly of over-forcing the bearing blocks into the gear cavity bore of the pump is substantially reduced, thus assuring that a correct and defined distance is established and repeatably maintained between the pump bearings and the pump gear faces, regardless of assembly clamping force.

24. The sanitary design gear pump as set forth in claim 22 wherein a gear cavity bore end seal ring is mounted on each bearing block adjacent the pilot portion, the parts being so arranged and constructed that the gear cavity bore seal arrangement minimizes the pump assembly mating force to correctly compress each seal ring in the pump.

25. The sanitary design gear pump as set forth in either claim 13 or 14 wherein each bearing block is provided with a pilot portion which extends into the gear cavity bore, the pump body bore which extends from one end to the other end of the housing having a pumping cavity which receives the gears, the length of the pumping cavity being defined by the length of the gear cavity bore and by the face of the pilot portion of the bearing blocks installed at each end of the pump body bore, this length of the pumping cavity defining the length of the longest gear which may be received in the pump.

26. The sanitary design gear pump as set forth in either claim 13 or 14 further comprising the provision of a drive gear dynamic shaft seal comprised of a single shaft seal cartridge assembly including a cartridge with a grip, which cartridge is removed from and installed onto its shaft by manually gripping or grasping the grip.

27. The sanitary design gear pump as set forth in claim 26 wherein the shaft seal cartridge assembly includes a shaft seal element, the cartridge assembly being mounted on the drive shaft between the drive gear and the drive end of the shaft, and wherein the drive end of the shaft has a diameter less than the diameter of the remained of the shaft to assure simple and easy seal installation onto and removal from the shaft of the shaft seal cartridge assembly with lowered risk of damage to the shaft seal element.

28. The sanitary design gear pump as set forth in claim 26 further characterized by the provision of a simple shaft seal clamp plate, and in which the single shaft seal cartridge assembly includes an external flange and seal rings, and wherein the cartridge assembly is retained in and sealed to the associated bearing block by the simple shaft seal clamp plate applied against the external flange on the seal cartridge and the outer face of the bearing block.

29. The sanitary design gear pump as set forth in claim 28 wherein the shaft seal clamp plate is provided with a non-circular aperture, and the cartridge is provided with a mating non-circular portion which is received in the non-circular portion of the shaft seal clamp plate when the parts are assembled, whereby the shaft seal cartridge assembly is prevented from rotating.

30. The sanitary design gear pump as set forth in claim 29 wherein the non-circular portions are male and female D-shaped elements.

31. The sanitary design gear pump as set forth in either claim 13 or 14 wherein the pump body bore which extends from one end to the other end of the housing has a generally oval shaped gear cavity bore which receives the gears, and cylindrical portions at each end of the oval shaped gear cavity bore, wherein each bearing block is provided with a cylindrical portion received in the cylindrical portion of the pump body bore and a pilot portion which extends into the gear cavity bore a small amount, and wherein a gear cavity bore end seal is mounted on each bearing block adjacent the pilot portion, the parts being so arranged and constructed that the bearing block and end seal arrangement allows seal disengagement immediately upon the start of withdrawal of the bearing block from the pump, thus greatly easing hand or manual pump disassembly by reducing and breaking the vacuum formed by such bearing block withdrawal.

32. The sanitary design gear pump as set forth in claim 31 wherein each bearing block pilot portion extends into the central oval shaped gear cavity bore only to the degree necessary to form two sides of a gear cavity bore end seal gland and to capture and align the bearing blocks and gear assemblies coaxially within the pump.

33. The sanitary design gear pump as set forth in either claim 13 or 14 wherein the diameter of the gear shaft of the drive gear is different from the diameter of the gear shaft of the driven gear, and wherein the gear shaft support bearings within each of the two gear shaft bearing blocks are of differing diameters, one to receive the gear shaft of the drive gear and the other to receive the gear shaft of the driven gear so as to preclude incorrect assembly of the pump.

34. The sanitary design gear pump as set forth in either claim 13 or 14 wherein the two gear shaft bearing blocks are of differing lengths for the drive and non-drive pump ends to preclude incorrect assembly of the pump.

* * * * *

UNITED STATES PATENT AND TRADEMARK OFFICE

CERTIFICATE OF CORRECTION

PATENT NO. : 6,808,374 B2
DATED : October 26, 2004
INVENTOR(S) : Iver J. Phallen et al.

It is certified that error appears in the above-identified patent and that said Letters Patent is hereby corrected as shown below:

Title page,
Item [73], Assignee, "Hypso Corporation, New Brishton, MN" should be
-- Hypro Corporation, New Brighton, MN --

Column 25,
Line 40, -- support -- should be inserted after "shaft".
Line 44, "0-09" should be -- 02-09 --.

Signed and Sealed this

Eighteenth Day of January, 2005

JON W. DUDAS
*Director of the United States Patent and Trademark Office*